US011015368B2

(12) United States Patent
DeBoer et al.

(10) Patent No.: US 11,015,368 B2
(45) Date of Patent: May 25, 2021

(54) INTEGRATED FENESTRATION STATUS MONITORING SYSTEM AND METHODS FOR THE SAME

(71) Applicant: Marvin Lumber and Cedar Company, Warroad, MN (US)

(72) Inventors: Nathan H. DeBoer, Salol, MN (US); Brian M. Farnes, Eagan, MN (US); Justin Magnusen, Eagan, MN (US)

(73) Assignee: Marvin Lumber and Cedar Company, LLC, Warroad, MN (US)

( * ) Notice: Subject to any disclaimer, the term of this patent is extended or adjusted under 35 U.S.C. 154(b) by 625 days.

(21) Appl. No.: 15/430,322

(22) Filed: Feb. 10, 2017

(65) Prior Publication Data

US 2017/0234033 A1 Aug. 17, 2017

Related U.S. Application Data

(60) Provisional application No. 62/447,295, filed on Jan. 17, 2017, provisional application No. 62/294,602, filed on Feb. 12, 2016.

(51) Int. Cl.
*E05D 15/22* (2006.01)
*E05B 17/22* (2006.01)
(Continued)

(52) U.S. Cl.
CPC ..... *E05B 17/22* (2013.01); *E05B 41/00* (2013.01); *E05B 47/00* (2013.01); *E05B 65/06* (2013.01);
(Continued)

(58) Field of Classification Search
CPC ..... E05B 55/00; E05D 15/22
(Continued)

(56) References Cited

U.S. PATENT DOCUMENTS 937,348 A 10/1909 Wheelock
3,525,830 A * 8/1970 Hawkins ..... E05B 45/06 200/43.08
(Continued)

OTHER PUBLICATIONS

"U.S. Appl. No. 16/035,341, Non Final Office Action dated Oct. 15, 2019", 19 pgs.
(Continued)

*Primary Examiner* — Jerry E Redman
(74) *Attorney, Agent, or Firm* — Schwegman Lundberg & Woessner, P.A.

(57) ABSTRACT

A fenestration assembly includes a fenestration frame and at least one panel movable between open and closed positions. A locking mechanism is coupled with the at least one panel and includes at least one latch and at least one latch fastener. The panel includes a secure configuration with the panel in the closed position and the latch coupled with the latch fastener. In the unsecure configuration one or more of the panel is in the open position or the latch is decoupled from the latch fastener. A status monitoring assembly monitors the secure and unsecure configurations and includes a sensor operator coupled with the latch, and a sensor coupled with one of the fenestration frame or the panel. In the secure configuration, the status monitoring assembly detects the sensor operator with the sensor if the panel is in the closed position and the latch is coupled with the latch fastener.

41 Claims, 15 Drawing Sheets

(51) Int. Cl.

| | |
|---|---|
| ***E05C 9/18*** | (2006.01) |
| ***E05C 1/06*** | (2006.01) |
| ***E05C 3/04*** | (2006.01) |
| ***E05B 41/00*** | (2006.01) |
| ***E05B 65/08*** | (2006.01) |
| ***E05B 47/00*** | (2006.01) |
| ***E05B 65/06*** | (2006.01) |
| ***E06B 3/36*** | (2006.01) |
| ***E06B 3/44*** | (2006.01) |
| ***E06B 7/28*** | (2006.01) |
| *E05C 7/00* | (2006.01) |

(52) U.S. Cl.
CPC ..... *E05B 65/08* (2013.01); *E05B 65/0841* (2013.01); *E05C 1/06* (2013.01); *E05C 3/046* (2013.01); *E05C 9/1875* (2013.01); *E05D 15/22* (2013.01); *E06B 3/36* (2013.01); *E06B 3/4415* (2013.01); *E06B 7/28* (2013.01); *E05B 2047/0068* (2013.01); *E05B 2047/0069* (2013.01); *E05C 2007/007* (2013.01)

(58) Field of Classification Search
USPC ..... 49/183, 184, 185, 449
See application file for complete search history.

(56) References Cited

U.S. PATENT DOCUMENTS

| | | | | |
|---|---|---|---|---|
| 3,641,540 | A * | 2/1972 | Cutler | G08B 13/08 200/61.74 |
| 4,346,372 | A | 8/1982 | Sandberg | |
| 4,465,997 | A * | 8/1984 | Hines | E05B 45/086 200/61.68 |
| 4,497,135 | A | 2/1985 | Vetter | |
| 5,004,961 | A | 4/1991 | Berner et al. | |
| 5,006,766 | A * | 4/1991 | Yuhas | E05F 15/619 318/53 |
| 5,226,256 | A * | 7/1993 | Fries | E05B 47/0012 49/13 |
| 5,311,168 | A * | 5/1994 | Pease, Jr. | E05B 45/06 200/61.93 |
| 5,355,059 | A * | 10/1994 | McMillan | E05F 15/611 318/102 |
| 5,382,060 | A | 1/1995 | O'Toole et al. | |
| 5,437,173 | A | 8/1995 | Spinar | |
| 5,449,987 | A * | 9/1995 | McMillan | G05B 19/042 318/266 |
| 5,595,075 | A * | 1/1997 | Chen | E05B 45/08 292/288 |
| 5,595,409 | A | 1/1997 | Fier et al. | |
| 5,653,485 | A | 8/1997 | Campbell | |
| 5,712,621 | A | 1/1998 | Andersen | |
| 6,212,923 | B1 * | 4/2001 | Clark | E05B 17/2092 70/416 |
| 6,615,629 | B2 * | 9/2003 | Bates | E05B 47/0607 70/107 |
| 6,778,086 | B2 * | 8/2004 | Morrone | E05B 65/0888 116/86 |
| 6,871,885 | B2 * | 3/2005 | Goldenberg | E05B 65/0841 292/14 |
| 7,042,353 | B2 * | 5/2006 | Stilp | G05B 9/03 340/539.22 |
| 7,068,162 | B2 * | 6/2006 | Maple | E05B 39/00 340/426.28 |
| 7,079,020 | B2 * | 7/2006 | Stilp | G06K 7/0008 340/506 |
| 7,158,029 | B1 * | 1/2007 | Martyn | E05B 45/083 200/19.35 |
| 7,227,463 | B2 * | 6/2007 | Merrell | G08B 5/226 340/407.1 |
| 7,355,515 | B2 * | 4/2008 | Lee | E05B 45/06 340/542 |
| 8,269,627 | B2 | 9/2012 | Gore et al. | |
| 8,624,736 | B2 | 1/2014 | Gore et al. | |
| 9,157,902 | B2 | 10/2015 | Gore et al. | |
| 10,138,658 | B2 | 11/2018 | Barton et al. | |
| 10,228,266 | B1 * | 3/2019 | McGruder | G08B 13/08 |
| 10,930,124 | B2 | 2/2021 | Fames et al. | |
| 2005/0140150 | A1 | 6/2005 | Hall et al. | |
| 2006/0033343 | A1 | 2/2006 | Xu | |
| 2007/0194914 | A1 * | 8/2007 | Gates | G08B 13/08 340/541 |
| 2007/0262848 | A1 * | 11/2007 | Berstis | G07C 9/00944 340/3.9 |
| 2008/0000162 | A1 * | 1/2008 | Zayac | E05B 17/2084 49/394 |
| 2008/0084299 | A1 * | 4/2008 | Fisher | E05B 47/02 340/542 |
| 2008/0211238 | A1 | 9/2008 | Stevens | |
| 2008/0246287 | A1 | 10/2008 | Satram et al. | |
| 2010/0207403 | A1 | 8/2010 | Bourgoin et al. | |
| 2013/0285391 | A1 | 10/2013 | Wolf et al. | |
| 2015/0252596 | A1 | 9/2015 | Liang et al. | |
| 2018/0202198 | A1 | 7/2018 | Hollermann et al. | |
| 2019/0019382 | A1 | 1/2019 | Farnes et al. | |

OTHER PUBLICATIONS

"U.S. Appl. No. 16/035,341, Examiner Interview Summary dated Sep. 30, 2020", 3 pgs.
"U.S. Appl. No. 16/035,341, Final Office Action dated Jun. 9, 2020", 19 pgs.
"U.S. Appl. No. 16/035,341, Notice of Allowance dated Oct. 21, 2020", 9 pgs.
"U.S. Appl. No. 16/035,341, Response filed Oct. 9, 2020 to Final Office Action dated Jun. 9, 2020", 12 pgs.
"Canadian Application Serial No. 3,001,471, Voluntary Amendment filed Nov. 3, 2020", 9 pgs.
"U.S. Appl. No. 15/873,707, Non Final Office Action dated Nov. 23, 2020", 34 pgs.
"U.S. Appl. No. 15/873,707, Examiner Interview Summary dated Mar. 15, 2021", 2 pgs.
"U.S. Appl. No. 15/873,707, Response filed Mar. 24, 2021 to Non Final Office Action dated Nov. 23, 2020", 27 pgs.

* cited by examiner

INTEGRATED FENESTRATION STATUS MONITORING SYSTEM AND METHODS FOR THE SAME

CLAIM OF PRIORITY

This patent application claims the benefit of priority of U.S. Provisional Patent Application Ser. No. 62/294,602, entitled "INTEGRATED FENESTRATION STATUS MONITORING SYSTEM AND METHODS FOR THE SAME," filed on Feb. 12, 2016, and Provisional Patent application Ser. No. 62/447,295, entitled "DOUBLE HUNG OPERATION HARDWARE," filed Jan. 17, 2017, which are hereby incorporated by reference herein in their entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright tights whatsoever. The following notice applies to the software and data as described below, and in the drawings, that form a part of this document: Copyright Marvin Lumber and Cedar Company d/b/a Marvin Windows and Doors, Warroad, Minn., All Rights Reserved.

TECHNICAL FIELD

This document pertains generally, but not by way of limitation, to status monitoring of fenestration assemblies including windows and doors.

BACKGROUND

Fenestration assemblies including door assemblies, window assemblies, and the like have one or more movable panels such as sashes or doors. The panels are movable relative to respective window and door frames. Security features are provided to fenestration assemblies to facilitate closing and locking of the assemblies to according secure a home, building or the like.

Confirmation of closing and locking of a fenestration assembly is accomplished in some examples with a plurality of sensors. Each sensor is configured to detect a status of the fenestration assembly. For instance, in one example, a sensor is provided to detect whether the door or sash of the fenestration assembly is closed. Another sensor (second sensor) is provided to detect if the door or sash is locked. The status of each sensor including detection of a closed condition by the first sensor and a locked condition by the second sensor is, for example, provided to a user remotely to indicate both status conditions of the assembly. That is to say open/closed and locked/unlocked status indicators for the fenestration assembly are provided to a user.

In another example, the output of the sensors including open/closed conditions from a first sensor and locked/unlocked conditions from a second sensor are interpreted by a controller (e.g., processor, memory, program or the like) to determine if the fenestration assembly is secure or unsecure. The controller provides a secure status if both the closed and locked conditions occur at the same time. However, if the first sensor detects the open condition and the second sensor detects either of the locked or unlocked conditions, the controller provides an unsecure status. Similarly, if the second sensor detects the unlocked condition and the first sensor detects either of the open or closed conditions the controller provides an unsecure status. Stated another way, the controller is provided with an algorithm that in effect provides a flow chart to determine the secure or unsecure status of the fenestration assembly.

Overview

The present inventors have recognized, among other things, that a problem to be solved includes reducing the number of sensors and supporting components needed to determine if a fenestration assembly is secure (closed and locked) or unsecure. In some examples, status monitoring systems use a plurality of sensors. Each of the plurality of sensors are configured to detect a separate condition of the assembly. For instance, a first sensor detects the locked/unlocked condition and a second sensor detects the closed/open condition. Spacing for the sensors is provided in or on the fenestration assembly. Where the sensors are provided in the fenestration assembly routing, molding or the like is used to provide sufficient space for the sensors. Where the sensors are provided on the fenestration assembly the aesthetic appeal of the assembly is decreased because of the visible installed sensors. Further, where a controller is used to interpret the conditions from the various sensors and output one or more status indicators for the fenestration assembly, additional space is allocated within the fenestration assembly for the controller, or optionally, the controller is fastened to the exterior of the fenestration assembly (thereby further decreasing the aesthetic appeal). Further still, the controller provides additional expense and labor for the status monitoring assembly because of additional electronics, coding (for algorithm) or the like.

The present subject matter provides a solution to this problem, such as by providing a status monitoring assembly including a sensor (e.g., sensor, switch or the like) configured to provide a secure status indicator with the fenestration assembly closed and locked. In one example a sensor and a sensor operator (e.g., a sensor assembly) are installed with the fenestration assembly. The sensor is configured to detect the sensor operator when the fenestration assembly is closed (e.g., the door, sash, or sashes are closed) and the locking mechanism is locked (e.g., a latch is coupled with a latch fastener). When both of these conditions are satisfied the sensor operator is detected by the sensor and a secure status for the assembly is achieved. In other permutations or conditions, where one or more of the panel is open or the locking mechanism is unlocked, the sensor fails to detect the sensor operator and accordingly the status monitoring assembly provides an unsecure status (including a failure to indicate the system is secure). Relatively complex logic (i.e., flowchart type algorithms) and associated controllers that assess multiple conditions from multiple sensors and output a status based on the assessment are thereby avoided.

The status monitoring assembly described in the examples herein thereby determines the secure and unsecure status through a consolidated system including one or more sensors (as opposed to requiring at least two sensors). Further, the status monitoring assembly performs this function without the use of a controller, algorithms, subscription to a service that broadcasts and optionally interprets) status data from the fenestration assembly or the like. Instead, the secure or unsecure status of the status monitoring assembly is in one example readily broadcast with a wireless transceiver (including a transmitter) and received at an output device at the home or with the user (e.g., a smartphone, tablet or the like).

Because the status monitoring assemblies described herein use a sensor and sensor operator and do not require multiple sensors, the integration of the assemblies with fenestration components (e.g., frames, doors, sashes or the like) is facilitated relative to the multiple components of other status monitoring systems having plural sensors, a controller and the like. Accordingly, routing of recesses and routing of interconnections for power and transmission (where included) are thereby reduced, and the status monitoring assemblies (including a sensor assembly, power source, transceiver or the like) are readily integrated with fenestration assemblies. Further, because of the minimal number of components, the status monitoring assembly is readily concealed within fenestration assemblies to maintain the aesthetic appeal of the assembly.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
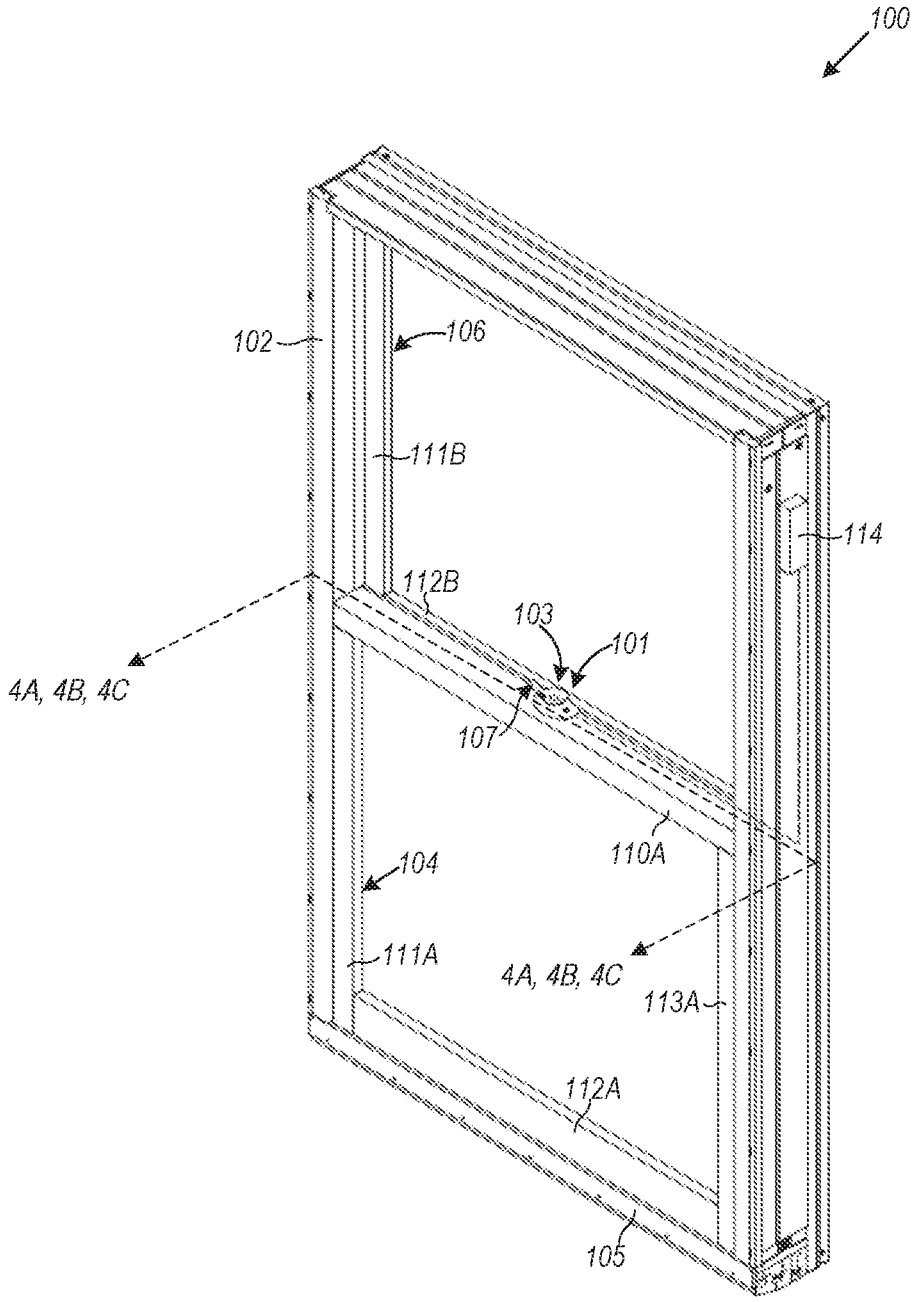
FIG. 1 shows one example of a fenestration assembly including a double hung window assembly.

Described herein are various configurations of devices and methods of a status monitoring assembly, for instance, for determining if fenestration units windows and doors) are secure (closed and locked) or unsecure (one or more of open or unlocked). The following examples and drawings illustrate the subject matter to enable those skilled in the art to practice the subject matter described in the following detailed description. Portions and features of some examples may be included in, or substituted for, those of other examples.

The fenestration assemblies described herein detect a secure configuration (and conversely an unsecure configuration) with use of a single integrated sensing system. In contrast, some other example products require multiple sensors to perform the same function. For instance, one sensor detects the open/closed status and another sensor detects the locked/unlocked status. One or more of dual indicators or logic algorithms are used to assess whether the corresponding fenestration unit is both closed and locked.

In examples of a casement fenestration family of products, the sensor is attached to a tie bar in a window frame. A sensor operator, for instance, a ferrous metal (or magnet) is located on a keeper. The sensor operator is attached to a sash (e.g., a casement window panel). In this configuration the status monitoring assembly detects the secure configuration if the sash is closed and the locking hardware is engaged in the locked position (e.g., a latch such as a latch bolt is coupled with the latch fastener such as a keeper). Optionally, there are no wires, cables or the like in the sash.

In one example of a double hung fenestration family of products, the sensors (one for each sash) are over provided in the latch receivers (e.g., latch fasteners), for instance, over molded into the receivers/recesses. The sensor operators for each of the panels, such as the respective top and bottom sashes, including but are not limited to ferrous, magnetic components or the like. The sensor operators are coupled with the respective latches (e.g., over molded, adhered, integral to the latch bolts or the like).

Optionally, for a bottom sash, a first sensor is provided to detect the locked and fully closed position, while a second sensor is provided to detect the locked and vent mode position (e.g., open approximately four inches). The status monitoring assembly is thereby able to sense at least two secure configurations (labeled 'secure' for the first and 'venting' for the second) with the bottom sash at the respective positions and the latch (latch bolt) and the sensor operator received in corresponding latch recesses (e.g., latch fastener) and sensed by the first or second sensor. For a top sash, a sensor is provided for the locked and closed position. In another example, the top sash and corresponding portions of the frame include first and second sensors corresponding to a closed and locked and locked and venting configurations as with the bottom sash.

With these status monitoring assemblies including the sensor and the sensor operator, even if the locking mechanism is positioned in the locked position (for instance an upper rail mounted latch operator), the sensors (first or second) will detect locked and closed (secure) or locked and vented (venting) if the sash is in fact in the locked and closed or locked and vented positions. This configuration also al lows each sash to detect locked and closed (secure) or unlocked or open (unsecure) configurations independently of one another. Optionally, there are no wires, cables or the like used in the window sashes.

In one example of a glider fenestration family of products, the sensor is coupled with the keeper (e.g., latch fastener) on a second sash. The sensor operator (e.g., a ferrous pin, magnet or the like) is coupled with the latch (e.g., integral to the bolt) on a first sash. With this configuration the glider fenestration unit is one or more of an XO, OX, XX, XOX, or OXXO configured unit (with X meaning a movable sash, O meaning a stationary sash, and the total number of O and X indicating the number of sashes in the unit). In a multiple sash embodiment with two or more sashes there is one sensor per pair of meeting stiles configured to monitor if the window (e.g., the instant pair of sashes at the respective meeting stile are closed and locked or unlocked or open).

In an example, an interface is provided including biased (e.g., spring loaded) contacts between one or more of the sashes and the fenestration frame. For instance, spring loaded contacts are provided in a power and data interface (frame interface) of the frame header and corresponding contacts are provided with the sensor assembly interface (panel interface) along a top meeting rail of the second sash. With the second sash in the closed position the status monitoring assembly, including the sensor assembly, is able to detect the sensor operator of the first sash because of electrical contact between the interfaces. Electrical continuity is thereby maintained between the frame of the fenestration unit and the second sash (as well as the first sash in its closed and locked position) without the need for wires. Accordingly, the second sash (having the sensor) is optionally removeable without needing to disconnect any wires or connectors.

In examples of door fenestration units of this disclosure, a cam surface (sensor operator) and a detect switch (sensor) are included in the locking mechanism between a face plate and key access point on an exterior of the door. When an operator or key is used to move the latch (e.g., deadbolt) the cam surface rotates causing the detect switch to change state (e.g., actuate), thereby indicating that the door panel is locked. A release feature in the locking mechanism is pushed in to allow the latch to move. The release feature is operable with the door panels in a closed position. Accordingly, the status monitoring assembly, for instance the sensor, detects the sensor operator with the door in the closed and locked configuration.

In another example, the fenestration unit, for instance a door unit, includes a second sensor assembly configured to monitor opening and closing of a panel such as a door. Accordingly, such a fenestration unit is configured to monitor a secure and unsecure configuration as described herein, and in some examples, also provides a separate notification of opening and closing of the panel (e.g., a door).

Optionally, the sensors used in the fenestration units are part of an overall system for processing and outputting sensor signals by a circuit card assembly (CCA). The CCA is optionally integrated into the window, for instance in a transceiver and power source (e.g., battery) are provided in a recess in one or more of the fenestration frame or panel. The CCA wirelessly broadcasts the sensors status on a radio frequency used by a bridge, professional installer, or similar device to inform an end user if the corresponding fenestration unit is closed and locked (secure) or unlocked or open (unsecure).

In one example, the systems described herein are factory installed and do not require a professional installer to integrate into a home automation system. Instead, the systems are configurable to broadcast on wireless frequencies for reception by an application (e.g., on a smart phone, tablet, personal computer, read out or the like). Professional installation and integration of the units is thereby minimized (e.g., reduced or eliminated). Further, communication and installation of third party security systems is optional to use the herein described systems as each of the systems is optionally configured to operate on its own.

FIG. 1 shows a perspective view of one example of a fenestration assembly 100 including a double hung window unit. The fenestration assembly 100 is configured for installation in a rough opening of a building or home. The fenestration assembly 100 includes a fenestration frame 102 and one or more panels movably coupled within the frame 102. For instance, the panels are slidably coupled within channels of the frame 102. In the example of FIG. 1, where the fenestration assembly 100 is a double hung window unit, the fenestration assembly 100 includes two panels (e.g., sashes), for instance a first panel 104 and a second panel 106. The panels include a sash having a plurality of rails supporting a window pane single, double, or triple pane glass). For instance, in FIG. 1, the first panel includes an upper rail 110A, lower rail 112A, a left stile 111A, and a right stile 113A. The second panel 106 includes an upper rail, a lower rail 112B, a left stile 111B, and a right stile. The panels or the frame 102 are optionally constructed from a material including, but not limited to, wood, vinyl, fiberglass, steel, or aluminum.

The first panel 104 and the second panel 106 are moveable between open and closed positions. For instance, the first panel 104 and the second panel 106 are moveable relative to each other and the fenestration frame 102. As shown in FIG. 1, the first panel 104 and the second panel 106 are in the closed position. For instance, the first panel 104 is positioned against a sill 105 of the frame 102 and the second panel 106 is positioned against a header 109 of the frame 102. The upper rail 110A is adjacent to the lower rail 112B. Optionally, weather stripping is located between the upper rail 110A and the lower rail 112B or between the panels and the frame 102. Accordingly, in the closed position, the first panel 104 and the second panel 106 provide a barrier (e.g., weather tight harrier) between an interior side and an exterior side of the fenestration assembly 100.

In the example of FIG. 1, the fenestration assembly 100 includes a locking mechanism 101 coupled between the first panel 104 and the second panel 106. For instance, the locking mechanism 101 includes an operating mechanism 107 (e.g., having a latch) coupled to the upper rail 110A and a keeper (having a latch fastener) coupled to the lower rail 112B. The latch is coupled to the latch fastener (locked) to secure the first panel 104 and the second panel 106 in the closed positions, as shown for example in FIGS. 3A and 3B and described further herein. In various examples, the latch and latch fastener include, but are not limited to, a latch bolt, spring latch, slam latch, cam lock, rotary latch, draw latch, compression latch, lockset, keeper, strike or other latch type.

The fenestration assembly 100 includes a secure and an unsecure configuration. For instance, the fenestration assembly 100 is in the unsecure configuration when one or more of the panels the first panel 104 or second panel 106) are in the open position, or the latch is decoupled from the latch fastener (unlocked), or a combination thereof.

As shown and described in the following examples, the fenestration assembly, for instance fenestration assembly 100, includes a status monitoring assembly 103 configured to monitor the secure and unsecure configurations. In various examples, the status monitoring assembly 103 includes a sensor, and a sensor operator. The sensor includes, but is not limited to, a magnetic switch (e.g., reed switch, balanced reed switch, magnetic sphere switch or the like), magnetic sensor, hall effect sensor, mechanical switch, electromechanical switch, electronic switch, ferrous proximity switch (e.g., inductive sensor), mercury tilt switch or other sensor used to detect proximity (or other proximity sensor or switch) or the like. The sensor operator includes, but is not limited to a ferrous metal (including ferrous metals and magnets), a mechanical contact, an electrical contact or the like. In some examples, the sensor is coupled to the latch fastener (such as the keeper) and the sensor operator is coupled to the latch, the panel, or the frame 102. In one example, the sensor detects when the latch (the latch acting as the sensor operator) is coupled with the latch fastener. In a further example, the sensor detects the sensor operator if the panel is in the secure configuration (e.g., with the panel in the closed position and the latch coupled with the latch fastener). The status monitoring assembly 103 provides a notification indicating the configuration of the fenestration assembly (e.g., one or more of the secure or unsecure configurations). Accordingly, the status monitoring assembly 103 detects the secure configuration (e.g., one or more panels in the closed position and one or more latches coupled with one or more respective latch fasteners) with a single sensor. Optionally, in further examples, a second or a plurality of sensors are used to detect the status of the fenestration assembly 100.

In some examples, the status monitoring assembly 103 includes a module 114. The module 114 includes, but is not limited to, one or more of a hard wired connection, a transceiver (e.g., including wired or wireless, transceivers or transmitters), power source (e.g., battery or power socket), controller, or the like. In a further example, the status monitoring assembly 103 operates without the use of a dedicated controller, algorithm, subscription to a service that broadcasts (and optionally interprets) status data from the fenestration assembly 100, or the like. For instance, the secure or unsecure status of the status monitoring assembly 103 is broadcast with the module (e.g., wireless transceiver) and received at an output device at the home or with the user (e.g., a smartphone, tablet, in home or building network, internet of things hub or the like).

Figure 2:
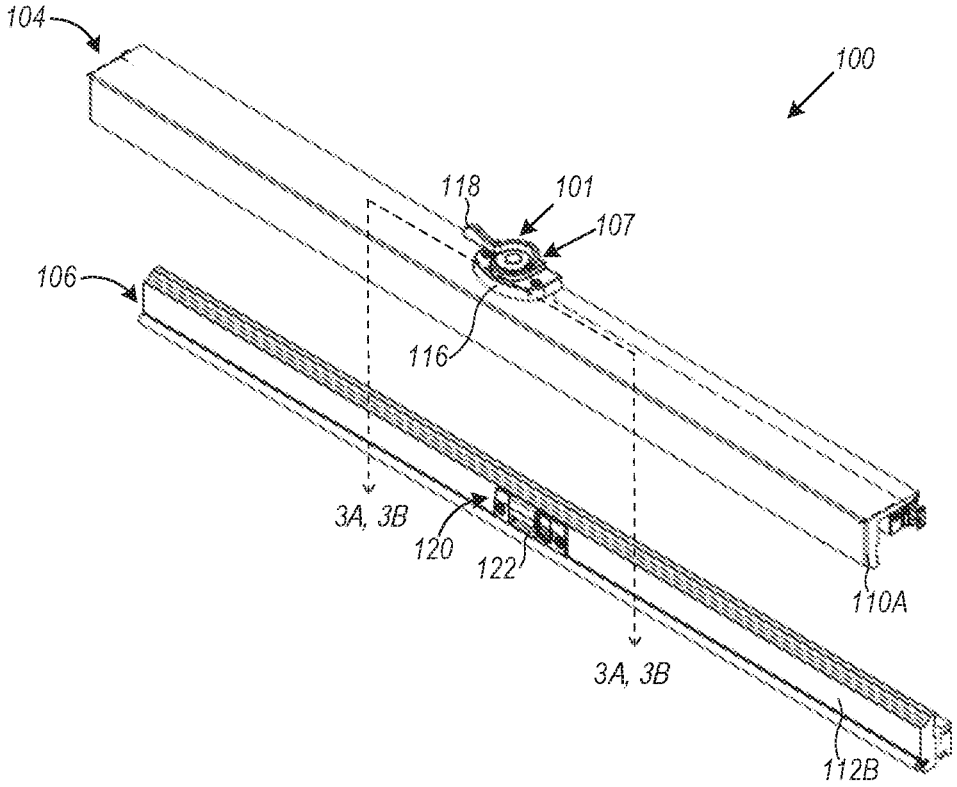
FIG. 2 is a detailed perspective view of one example of a first panel in an open position and decoupled from a second panel.

FIG. 2 depicts a detailed perspective view of a portion of the first panel 104 in an open position relative to the second panel 106, and the locking mechanism 101 is unlocked. For instance, in the open position, the first panel 104 or second panel 106 are moved with respect to the frame 102 to provide an opening through the fenestration assembly 100.

Figure 3A:
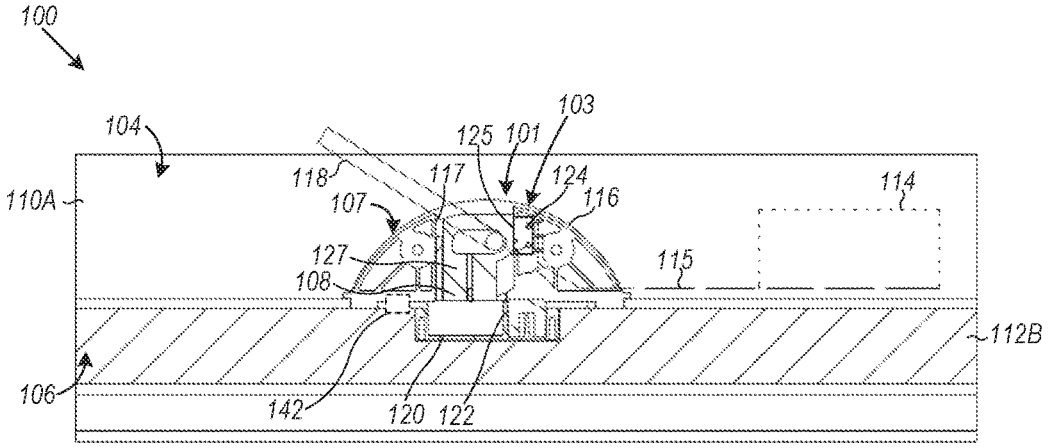
FIG. 3A is a section view of one example of a top rail of a lower sash and a bottom rail of an upper sash of a fenestration assembly in an unsecured configuration.
Figure 3B:
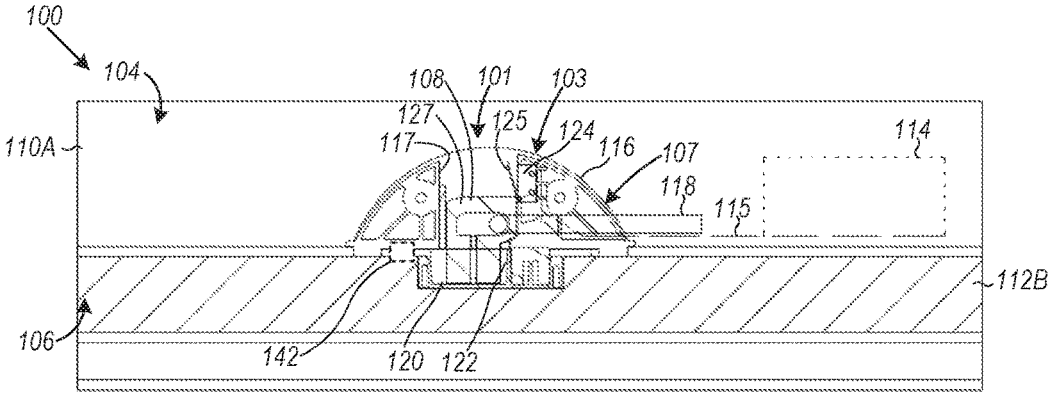
FIG. 3B illustrates another cross section of a top rail of a lower sash and a bottom rail of an upper sash of a fenestration assembly in a secure configuration

In the example shown in FIG. 2, the locking mechanism 101 includes an operating mechanism 107, a latch (e.g., the latch 108 as shown as described further herein), and a latch fastener 120. The operating mechanism 107 includes an operator housing 116, an operator 118 (such as a lever, crank or the like), and the latch movably coupled with the operator housing 116. The latch is shown in the example of FIGS. 3A and 3B and discussed further herein. The operator 118 includes, but is not limited to, a handle, lever, slider, grip, button, crank, or the like. In this example, the operator housing 116 is attached to the upper rail 110A. For instance, the operator housing 116 is optionally located on or within the upper rail 110A. The operator 118 is movably coupled to the operator housing 116 and operates the latch 108 (e.g., coupling or decoupling the latch with the latch fastener 120). In the example of FIG. 2, the operator 118 is rotatably coupled to the operator housing 116 and translates the latch. In one example, the latch fastener 120 includes a keeper, and the keeper includes a latch recess 122. The latch fastener 120 is attached to the lower rail 112B. In one example, the latch 108 is received in the latch fastener 120 (e.g., a keeper) to lock the respective panels 104, 106 in the closed position.

FIG. 3A shows a cross section of one example of the fenestration assembly 100 coupled with the upper rail 110A and the lower rail 112B. In this orientation the first panel 104 and the second panel 106 are in respective closed positions, and accordingly, the upper rail 110A is near (e.g., adjacent, aligned or the like) the lower rail 112B. In the example of FIG. 3A, the operating mechanism 107 includes the operator housing 116, the operator 118, the latch 108 (e.g., a latch blade), a latch channel 117, and the sensor 124. In one example, the latch channel 117 is located in the operator housing 116 and receives the latch 108. In the example shown, the latch 108 includes a latch blade. The latch blade includes an elongate shape (e.g., a pin, wedge, plate or the like) selectively coupled with the latch fastener 120. In other examples, the latch 108 includes, but is not limited to, a pin, bolt, lug, claw, guillotine-type latch or the like configured for coupling with the latch fastener 120.

The sensor 124, in the example of FIG. 3A, includes an electromechanical detect switch. The latch 108 (such as the latch blade) is used as the sensor operator. For example, the sensor 124 includes an actuator 125. The actuator 125 engages with the latch 108 when the latch 108 is in the decoupled configuration (e.g., withdrawn position shown in FIG. 3A). As shown in FIG. 3A (an unsecure configuration with the latch unlocked), the latch 108 is at least partially withdrawn into the latch channel 117 and separated from the latch fastener 120. In one example, the sensor 124 opens a circuit indicating the fenestration assembly is unsecure (in this example unlocked). For instance, when at least partially withdrawn from the latch fastener 120, the latch 108 biases the actuator 125 and accordingly opens the circuit within the sensor 124 (e.g., a normally open switch) when the latch 108 is in the unlocked position (e.g., unsecure configuration) as shown in the example of FIG. 3A. In one example, the sensor 124, the sensor operator (in this example, the latch 108), or both are concealed within one or more of the fenestration frame 102, the first panel 104, or the second panel 106.

In one example, the locking mechanism 101 includes a release 142. One example of the release 142 is described in the Provisional Patent Application Ser. No. 62/447,295, which is incorporated by reference herein in its entirety. The release 142 prohibits the latch 108 from moving from the decoupled configuration (e.g., retracted position) to the coupled configuration (e.g., extended and latched position) unless the release 142 is engaged with the latch fastener 120 or the second panel 106. For instance, when the first panel 104 or the second panel 106 are in the open position, the release 142 is extended from the panel 104. Closing of the sashes engages the release with the 142 with the latch fastener 120 or the second panel 106. The movement of the engaged release 142 frees the operating mechanism (e.g., including the operator 118) to move the latch 108 from the withdrawn (FIG. 3A) to the deployed (FIG. 3B) configuration when the first panel 104 and the second panel 106 are in the closed position. In one example, the release 142 includes a pin or slider that engages the latch fastener 120 or the second panel 106 when the first panel 104 and the second panel 106 are in the closed position. In one example, the release 142 engages with the latch fastener 120 (e.g., a feature or protrusion) and translates (e.g., moves) when transitioning between engagement and disengagement with the latch fastener 120. The release 142 is moved to the engaged position when the first panel 104 and the second panel 106 are in the closed positions. The release 142 includes a mechanical linkage operatively coupled between the operator 118 and the latch 108. Accordingly, in the example of FIGS. 1A and 1B, the locking mechanism 101 cannot be moved to the locked configuration unless the first panel 104 and the second panel 106 are closed. When the release 142 is in an engaged position and the sensor 124 detects the sensor operator 127, the status monitoring assembly 103 detects the secure configuration as the first panel 104 and the second panel 106 are locked (e.g., the locking mechanism 101 is locked by closing) and the first and second panels 104, 106 are correspondingly closed. Accordingly, the status monitoring assembly 103 detects the secure configuration (locked and closed) with a single sensor (sensor 124).

As shown in the example of FIG. 3A, the fenestration assembly 100 is in one example of an unsecure configuration (e.g., unlocked). For instance, the latch 108 is decoupled from the latch fastener 120. In this example, the status monitoring assembly 103 reports the unsecure configuration when the sensor operator (e.g., latch 108) is not detected by the sensor 124 (e.g., the latch 108 as the sensor operator is deployed away from the sensor 124). Accordingly, even if the first panel 104 and the second panel 106 are in closed positions and may appear secure, the status monitoring assembly 103 detects the unsecure configuration based on the detected decoupling of the latch 108 from the latch fastener 120 based on the corresponding position of the actuator 125.

In various examples, the status monitoring assembly 103 includes a module 114 including, but not limited to, a controller, transceiver (including a transmitter), power source, or combinations thereof as described herein. The sensor 124 is in electrical communication with the module 114 to communicate the detection of the secure and unsecure configurations. In the example of FIGS. 3A and 3B, the module 114 (e.g., a transceiver) is coupled to the upper rail 110A. The module 114 is electrically coupled to the sensor 124 with one or more wires 115. The module 114 (transceiver) is configured to wirelessly communicate with a controller, receiver or the like of the status monitoring assembly 103 including a device or virtual device having an application thereon. For instance, an application usable with the status monitoring assembly 103 operates on one or more of a smart phone, tablet, personal computer, home or business network, internet of things hub or the like.

In a further example, where the sensor 124 is coupled to the frame 102 or to a non-operative (e.g., fixed) panel, the sensor 124 is hardwired to the controller. For instance, in the example of a single hung window, the second panel 106 is fixed to the frame 102. The wire 115 is concealed within the second panel 106 and extends through the frame 102 to provide electrical communication between the sensor 124 and the controller or to communicate power between a power source and the sensor 124. For instance, the power source includes a battery or power socket providing power to one or more of the sensor 124, controller, or the transceiver. In one example, the module includes the controller or control module. In various examples, the module (e.g., power source, the transceiver, or wires) are concealed within the panel 106, for example, within one or more of the rails or stiles (e.g., rails 110A, 112A, 112B, 111A, 111B, or 113A) of the panel. In a further example, the module 114 is concealed, at least partially, within the frame 102. Accordingly, the status monitoring assembly 103 is operable (e.g., communicates the secure or unsecure status of the fenestration assembly 100) while also concealed from view. The status monitoring assembly 103 described herein thereby maintains the aesthetic appeal of a fenestration assembly including monitoring assembly.

Figure 4A:
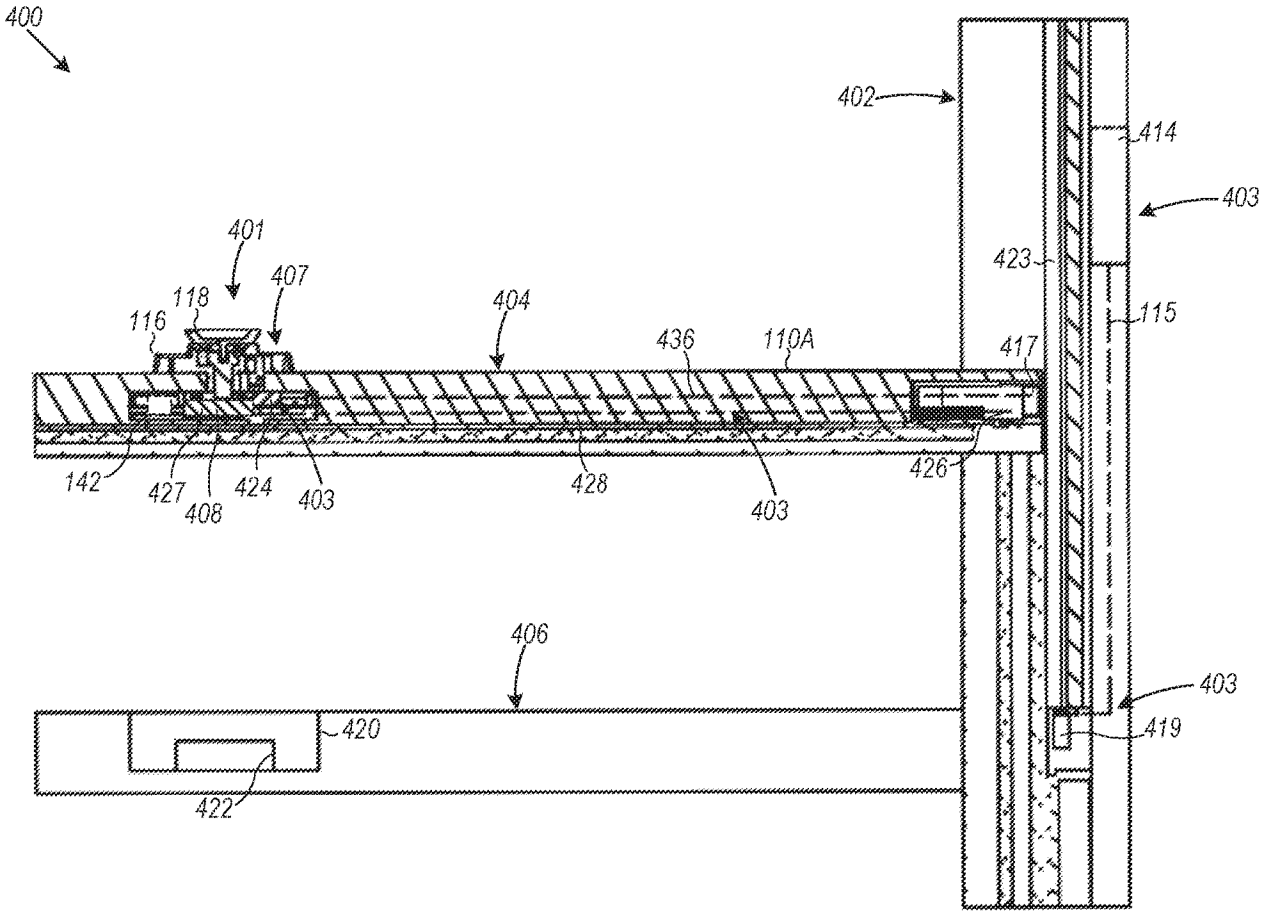
FIG. 4A depicts a cross section of one example of a fenestration assembly including a further example of a locking mechanism and a first panel in an unsecure configuration.
Figure 4B:
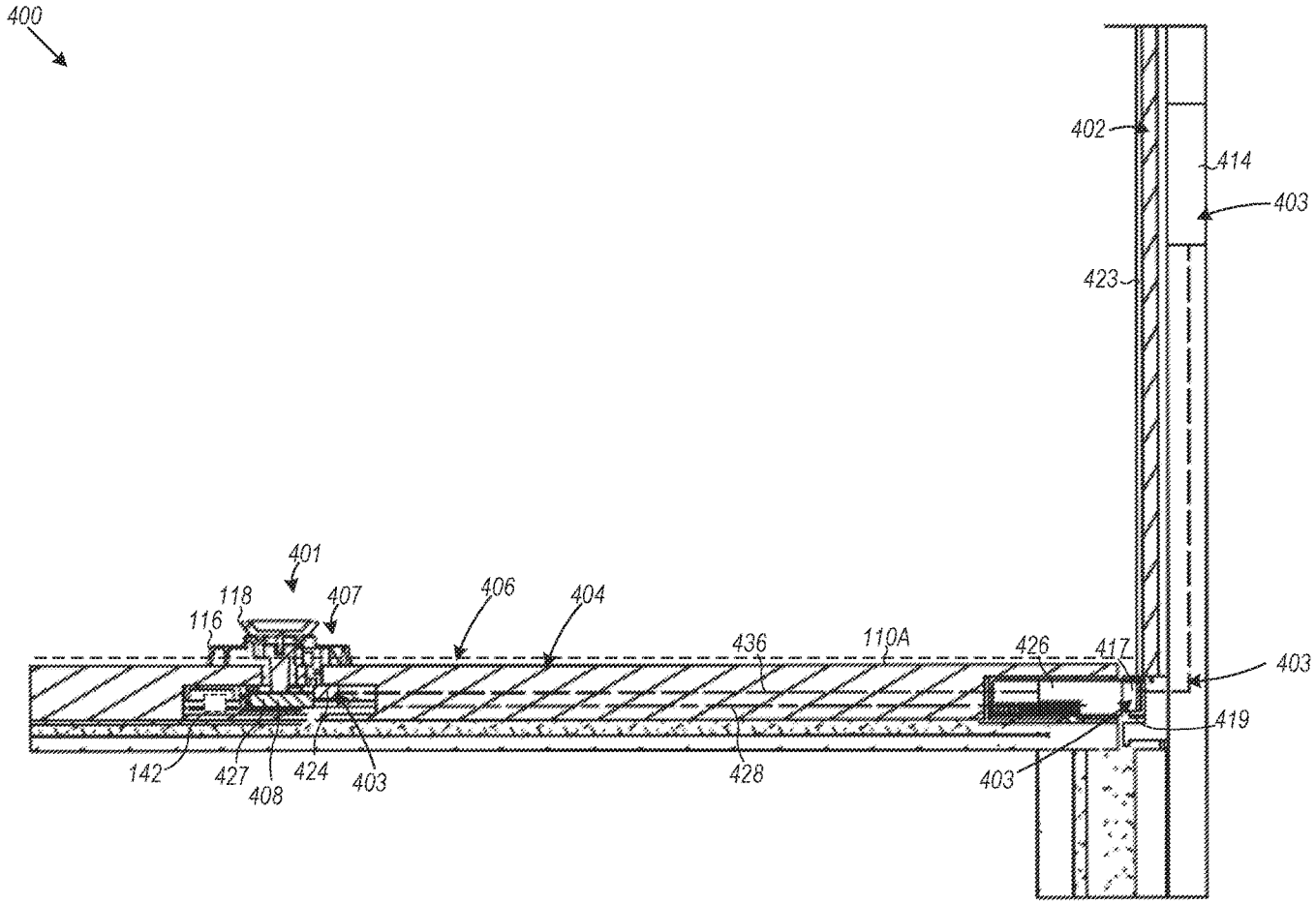
FIG. 4B illustrates a cross section of the fenestration assembly of FIG. 4A including one example of a locking mechanism and first panel in the secure configuration.

FIG. 3B illustrates another cross section of the fenestration assembly 100 in the secure configuration. The latch 108 is in the locked position (e.g., extended into the latch fastener 120 and received in the latch recess 122) based on actuation of the operator 118 (e.g., a rotation of the operator 118 as shown between FIGS. 3A, 3B whether through user control of the operator 118 or in conjunction with the release 142 engaging with one or more of the latch fastener 120 or other feature coupled with the second panel 106 to free the operator 118 to move into the locked position. Where the locking mechanism 101 is in the locked configuration, the actuator 125 is in an unactuated position. In this example, the actuator 125 is biased into the latch channel 117 without the latch 108 to oppose the movement. In this example then the sensor 124 accordingly detects the latch 108 is translated toward the latch fastener 120 (based on the position of the actuator 125). In the example shown in FIG. 3B, where the sensor 124 acts as a switch, a circuit including the circuit within the sensor 124 is closed and thereby indicates the locking mechanism 101 is locked. In this example, the status monitoring assembly 103 detects the secure configuration when the locking mechanism 101 is locked and the panels 104, 106 are closed. For instance, in an example described above, operation of the locking mechanism 101 is permitted when the panels 104, 106 are closed, and accordingly the detection of locking also indicates the panels 104, 106 are closed as well. FIGS. 4A and 4B discuss another example of detecting whether the panels 104, 106 are in the closed position.

Figure 4C:
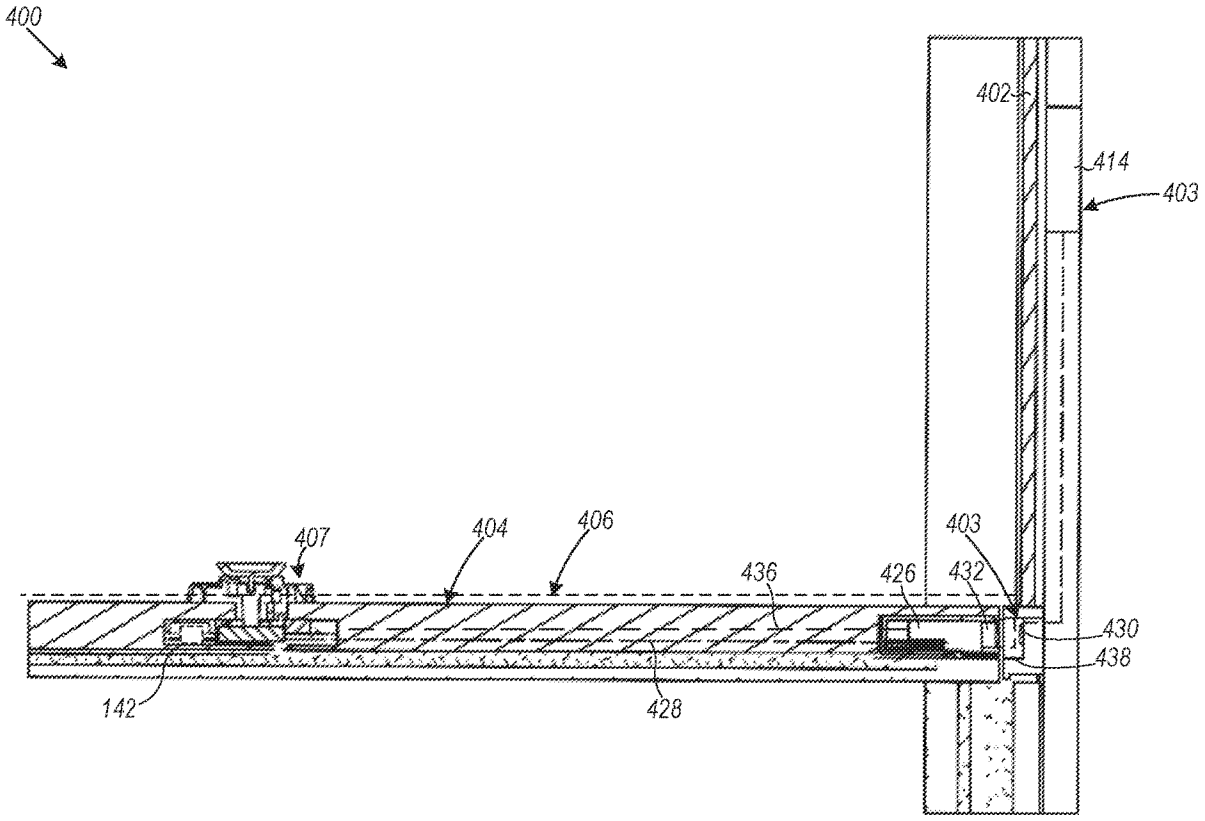
FIG. 4C depicts one example of a fenestration assembly including a locking mechanism and a status monitoring assembly.

FIGS. 4A and 4B depict a cross section of a fenestration assembly 400 in both open (at least partially) and closed positions, respectively, including a further example of a locking mechanism 401. The fenestration assembly 400 includes a first panel 404 movably coupled to a frame 402, a locking mechanism 401, and a status monitoring assembly 403. The locking mechanism 401 is coupled with at least one panel (e.g., panel 404 or panel 406). In FIGS. 4B and 4C, the second panel 406 is located behind the first panel 404 and is accordingly shown in broken line to indicate the otherwise concealed second panel 406. In the example of FIGS. 4A and 4B, the locking mechanism 401 is coupled to the first panel 404 and the second panel 406. The locking mechanism 401 is configured to lock the first panel 404 and the second panel 406 in the closed position with respect to the frame 402. The status monitoring assembly 403 includes at least a sensor 424 (e.g., similar in some examples to sensor 124, shown in FIGS. 3A and 3B) and a sensor operator 427 (e.g., sensor operator 127, shown in FIGS. 3A and 3B), wiring (e.g., wiring 115 as shown in FIGS. 3A and 3B), a module 414 (e.g., the module 114 shown in FIGS. 1, 3A and 3B), a controller, interfaces (such as a panel interface 417 and frame interface 419 discussed below) or the like.

In a further example, the status monitoring assembly 403 includes the panel interface 417 (e.g., sash interface) coupled to the first panel 404 and at least one frame interface 419 coupled to the frame 402. In one example, the frame interface 419 is electrically coupled (e.g., hardwired) to a module 414 including, but not limited to, one or more of a transceiver, controller or power source. In further examples, the fenestration assembly 400 includes a plurality of panel interfaces coupled to respective panels of the fenestration assembly, and these panel interfaces are coupled to a corresponding plurality of respective frame interfaces when the respective panels are closed. For instance, when the first panel 404 is closed (e.g., in the closed position), the status monitoring assembly 403 is communicatively coupled to one or more of the transceiver, controller, power source (e.g., module 414), or the like, through the panel interface 417 and the frame interface 419. In some examples, the module 114 (e.g., transceiver, controller, or power source) is optionally concealed within the frame 402. In the example of FIGS. 4A and 4B, the module 414 is located within the frame 402. The status monitoring assembly 403 is configured to sense (e.g., detect or report) the secure and unsecure configuration of the fenestration assembly 400. For instance, in the secure configuration, the locking mechanism 401 is locked and the panel (e.g., each of the first panel 404, the second panel 406, or both) is in the closed position. The sensor 424 detects deployment of the latch to a locked position and an electrical circuit that transmits the sensor output is closed when the panel and frame interfaces 417, 419 are electrically coupled when at least the first panel 404 is closed. In the unsecure configuration, at least one of the locking mechanism 401 is unlocked or at least one of the panels (e.g., first panel 404 or second panel 406) are in the open position. For instance, when the panel interface 417 is disengaged with the frame interface 419, the open circuit between the sensor 424 and the module 414 prevents communication to or from the sensor 424 and correspondingly, the unsecure status is detected. In a further example, the sensor 424 only detects the sensor operator 427 (the latch 408) when the first panel 404 and the second panel 406 are closed, and accordingly, the unsecure status is detected.

The locking mechanism 401 includes a latch 408 (similar to the latch 108) and a latch fastener 420 (similar to the latch fastener 120) as previously described herein. In a locked position, the latch 408 (e.g., latch blade) is coupled to the latch fastener 420 (received in a latch recess 422). In the unlocked position, the latch 408 is decoupled from the latch fastener 420. The locking mechanism 401 includes an operating mechanism 407. For instance, the operating mechanism 407 includes in an example the operator 118 (e.g., handle, lever, slider, grip, button, crank, or the like), operator housing 116 and latch 420, as previously described. In a further example, the locking mechanism 401 includes the release 142 (as shown in FIGS. 3A and 3B and described herein) to free the locking mechanism to move to the locked configuration when the first panel 404 and the second panel 406 are closed. For instance, the locking mechanism 401 is held open (unlocked) with one or more of the panels 404, 406 opened, and the mechanism 401 is released to close when both panels 404, 406 are closed and the release 142 is moved. Accordingly, the status monitoring assembly 403 in one example detects the secure configuration upon locking of the locking mechanism 401 that also requires closing of both of the panels 404, 406.

The panel interface 417 is configured for electrical communication with the frame interface 419. The frame interface 419 and the panel interface 417 include, but are not limited to, fixed contacts, spring contacts, spring probes or the like. The frame interface 419 is attached to the frame 402, for example, at a position to engage with the panel interface 417 when the first panel 404 is in the closed position. The panel interface 417 is optionally positioned on one of the first panel 404 or the second panel 406 or both. In the example shown in FIGS. 4A and 4B, the panel interface 417 is located on the first panel 404. In one example, the panel interface 417 is coupled with a latch bolt 426 and the frame interface 419 includes contacts within a frame channel 423 of the frame 402 as shown in FIG. 4A. In various examples, one or more electrical contacts are located along one or more of the sides or a tip portion of the latch bolt 426 to form the panel interface 417.

In one or more examples, the latch bolt 426 couples an upper portion of the first panel 404 (e.g., an upper rail 410) to the frame channel 423 within the frame 402. As shown in the example of FIGS. 4A and 4B, the latch bolt 426 is operatively coupled to the operating mechanism 407. For instance, the latch bolt 426 is movably coupled within the upper rail 410 by the operator 118 between a coupled configuration (e.g., allowing sliding movement of the panel in the frame) and a sash tilt configuration (e.g., unlocked and allowing tilt of the panel). In another example, the operator 118 optionally includes three or more positions, the locked position (e.g., the latch 408 is coupled with the latch fastener 420 and the latch bolt 426 is received in the frame channel 423), the unlocked position (e.g., the latch 408 is decoupled from the latch fastener 420 and the latch bolt 426 is received within the frame channel 423 and allows sliding movement of the panel), and the sash tilt configuration (e.g., the latch 408 is decoupled from the latch fastener 420 and the latch bolt 426 is withdrawn from the frame channel 423). If the first panel 404 is closed and the latch bolt 426 is received in the frame channel 423 the panel interface 417 is electrically coupled with the frame interface 419.

A tie element 428, such as a tie bar, is configured to translate within the upper rail 410 based on the movement of the operator 118 (e.g., one or more of rotation or translation movement). Accordingly, the latch bolt 426 is translated between a coupled configuration and a sash tilt configuration corresponding to the position of the operator 118. As shown in the example of FIGS. 4A and 4B, the latch bolt 426 is coupled to the operating mechanism 407 with the tie element 428. The latch bolt 426 is optionally spring loaded and biased toward the coupled configuration (e.g., deployed from the first panel 404). The tie element 428 moves the latch bolt 426 toward the decoupled configuration when the operator 118 is moved to sash open or sash tilt positions.

The first panel 404 includes an open, a closed, and a tilted position. Where the latch bolt 426 is withdrawn from the frame channel 423, as shown in the example of FIG. 4A, the first panel 404 is rotatable with respect to the frame 402 or separable from the frame 402. For instance, where a lower rail 412 of the first panel 404 is coupled to the frame 402, the first panel 404 is rotatable to tilt about the lower rail 412 for cleaning or the like. In a further example, where the latch bolt 426 is withdrawn from the frame channel 423, the first panel 404 is optionally separable from the frame 402.

The example of FIG. 4A depicts one example of an unsecure configuration (e.g., with one or more of the panels unlocked or open or both). For instance, the panel interface 417 is not engaged with the frame interface 419 (e.g., the latch bolt 426 is misaligned with the frame interface 419 according to the panel open position). Correspondingly, the circuit is broken and the sensor 424 is not communicatively coupled to report the status of the locking mechanism 401.

The status monitoring assembly 403 reports the unsecure configuration, for instance, with the use of a single sensor 424 (like the sensor 124).

In a further example, where the release 142 is disengaged from the latch fastener 420 or the second panel 406 or the latch 408 is otherwise positioned in the unlocked position, the unsecure configuration is detected based on the unlocked configuration of the locking mechanism 401, even though the panels 404, 406 in the closed positions and the panel interface 417 is engaged with the frame interface 419 (e.g., because the latch is withdrawn and detected by the sensor).

In another example, wherein the fenestration assembly includes the latch bolt 426, and the latch bolt 426 is withdrawn from the channel 423, the unsecure configuration is detected even though the panels 404, 406 are closed and the locking mechanism is in the locked configuration based on the open circuit caused by the panel interface 417 (on the latch bolt 426) disengaged with the frame interface 419 (electrical contacts coupled to the frame 402).

In one example of the fenestration assembly 400 (as shown in FIG. 4A), the unsecure configuration occurs when one or more of the panels 404, 406 are open. Accordingly, in any of the unsecure configurations, one or more of the panels 404, 406 are in the open position, or the latch 408 is decoupled from the latch fastener 420, or the panel interface 417 is decoupled from the frame interface 419 (whether through opening one of the respective panels or operation of the operator 118 to move the latch 408 to the unlocked position) and the status monitoring assembly 403 detects the unsecure configuration with the unitary sensor 424 provided at the locking mechanism 401.

In one example of the secure configuration, the first panel 404 and the second panel 406 are in the closed positions, the latch 408 is coupled with the latch fastener 420, and the panel interface 417 is electrically coupled with the frame interface 419. In a further example, the locking mechanism 401 includes the release (release 142 as shown in FIGS. 3A and 3B as described herein), the locking mechanism is only locked when the panels 404, and 406 are in the closed positions. Accordingly, a single sensor 424 (unitary sensor) reports the secure configuration by detecting the locking mechanism is locked. In one example, the sensor 424 is configured to communicate the detection of the sensor operator 427 (e.g., the latch 408) if the first panel 404 is in the closed position (and the panel interface 417 is correspondingly engaged with the frame interface 419) and the latch (e.g., latch 408) is coupled with the latch fastener 420 (and the sensor 424 correspondingly detects the absence of the sensor operator 427 and is communicatively coupled to the module 414 through the panel interface 417 and the frame interface 419).

FIG. 4C depicts one example of a latch recess 438 coupled with the frame 402. The latch recess 438 is configured to couple with the latch bolt 426, for instance, to secure the first panel 404, the second panel 406, or both to the frame 402. Stated another way, the latch bolt 426 is used in this example to lock one or more of the first or second panels 404, 406 in the closed position (in contrast to the examples described above using a latch provided in the locking mechanism 401 near the operator 118). In one example, the latch recess 438 receives the latch bolt 426 to lock the first panel 404 to the frame 402. One example of the unsecure configuration includes the latch 426 withdrawn from the latch recess 438 (as shown in FIG. 4C) to permit sliding movement of the panel 404 within the frame 402.

As shown in the example of FIG. 4C, the fenestration assembly 400 optionally includes a sensor 430 and a sensor operator 432 for detecting the latch bolt 426 is received within the latch recess 438. In one example, the sensor operator 432 is located on the latch bolt 426 and the sensor 430 is located within the latch recess 438. The status monitoring assembly 403 reports the secure configuration when the sensor 430 detects the sensor operator 432 (e.g., when the latch bolt 426 is received in the latch recess 438) and the panels of the fenestration assembly 400 are closed. In the example of FIG. 4C, the first panel 404 is located in the closed position and the latch bolt 426 is received within the latch recess 438.

In some examples, monitoring the secure and unsecure configurations of the fenestration assembly 400 includes monitoring the closed or open positions of a second panel (the second panel 406) or other panels of fenestration assemblies. In the example of FIG. 4C, the second panel 406 and the first panel 404 are in the closed position, and thus the second panel 406 is aligned behind the first panel 404 and represented in hidden line. The second panel 406 optionally includes a second sensor operator and a second sensor. In one example, the second sensor is located on the frame 402 and the second sensor operator is located on the second panel 406. In further examples, the second sensor is located in a second latch fastener and the second sensor operator is located on a second latch. In another example, the second sensor operator is a second sensor (e.g., reed switch) located in a second latch recess on the frame 402, and the second sensor operator is a second latch bolt received in the second latch recess when the second panel 406 is in the closed position. Accordingly, the second sensor detects the second sensor operator when the second panel 406 is in the closed position, or the second latch is coupled with the second latch fastener, or both.

In a further example, the second panel 406 includes a second panel interface (similar to the panel interface 417 as previously described) engaged with a second frame interface (similar to the frame interface 419) when the second panel 406 is in the closed position. A second locking mechanism is communicatively coupled to report the status of the second panel 406 through the second panel interface and second frame interface. In a further example, the second panel 406 includes a panel interface configured as a jumper to complete a circuit routed through a second frame interface when the second panel 406 is in the closed position. Correspondingly, the status monitoring assembly detects when the second panel 406 is in the closed position.

Figure 5A:
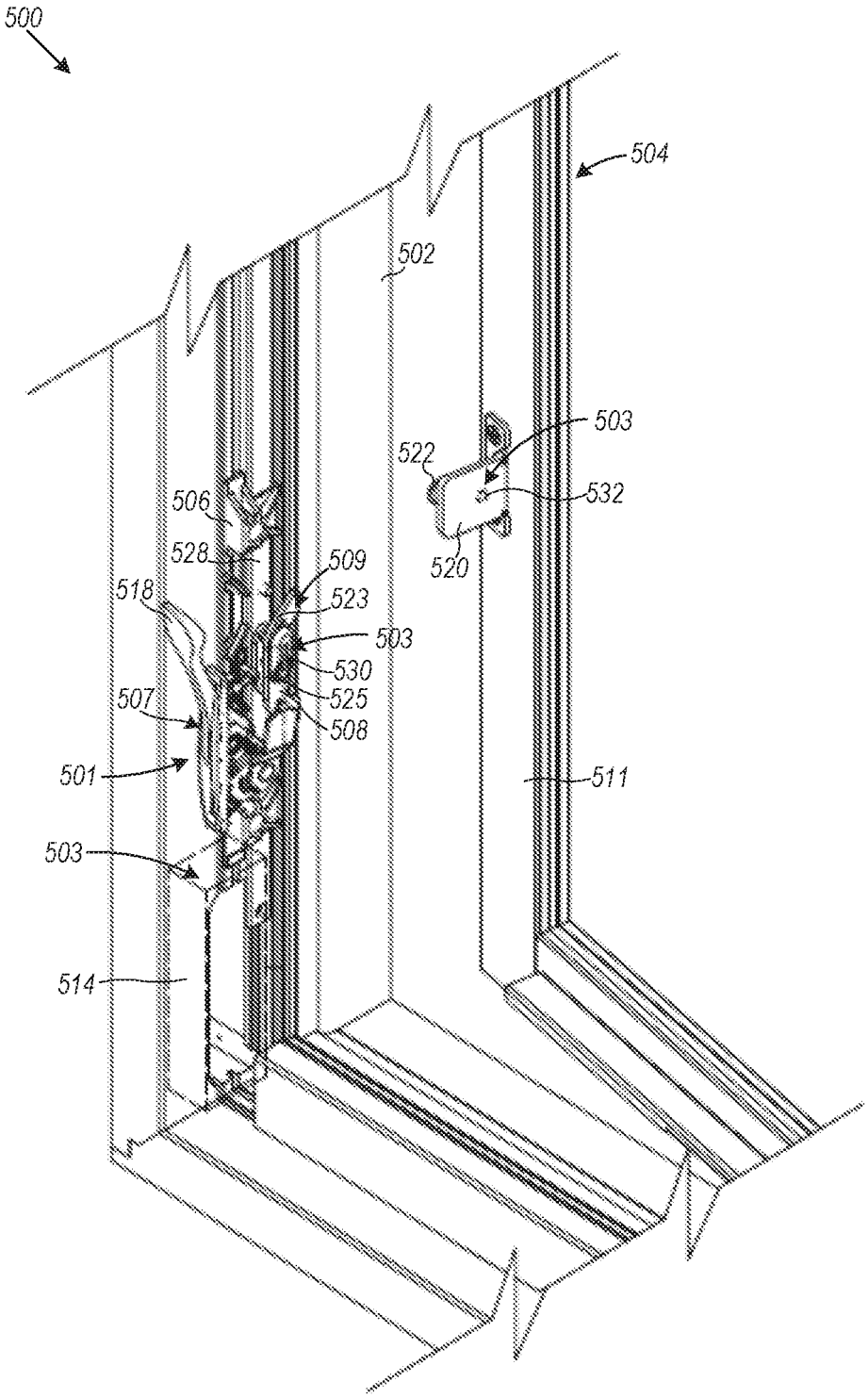
FIG. 5A is a perspective view of one example of a fenestration assembly including a casement window in the unsecured configuration.
Figure 5B:
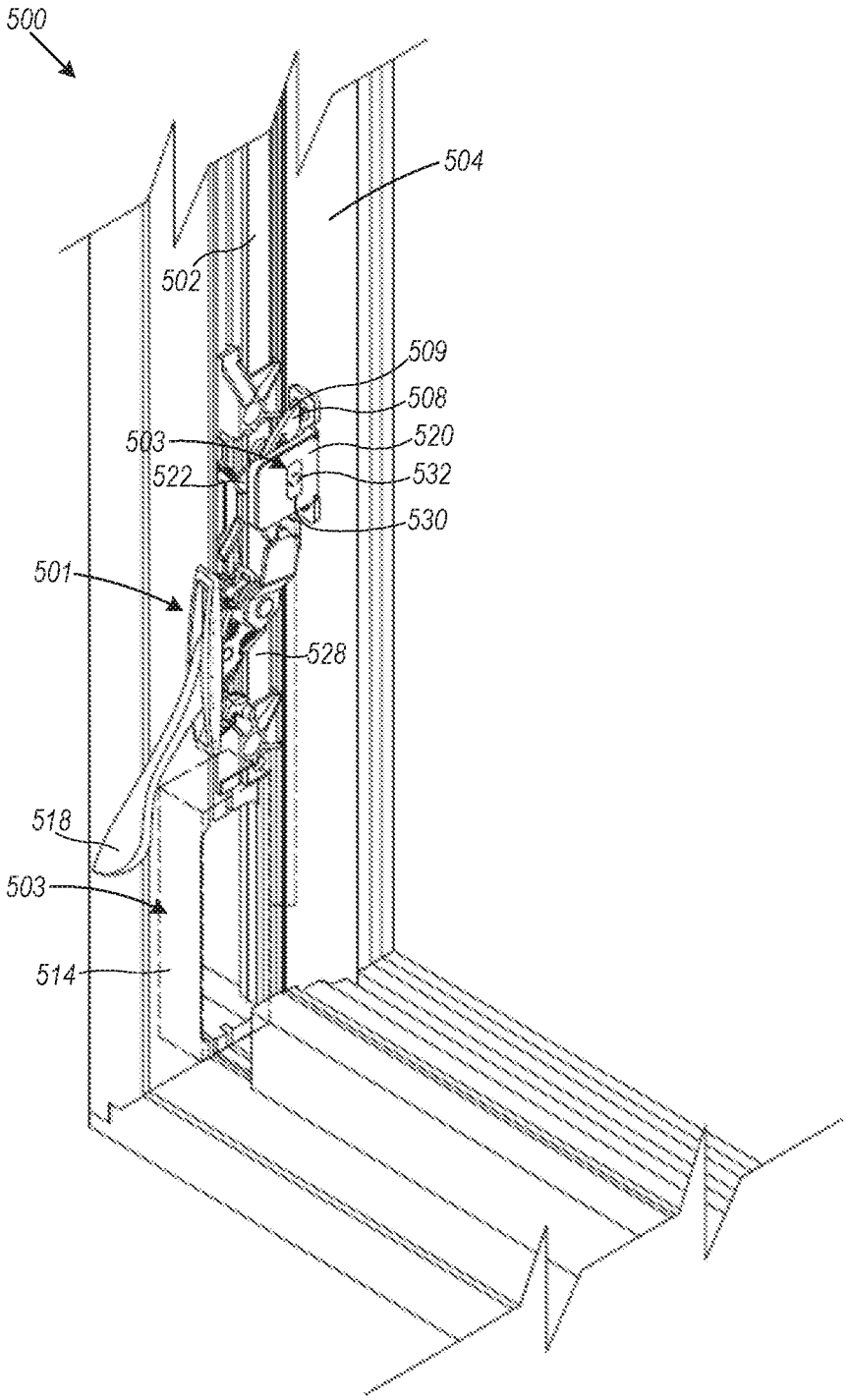
FIG. 5B is a perspective view of one example of the casement window of FIG. 5A in a secure configuration.

FIG. 5A is a perspective view of one example of a fenestration assembly 500 including a casement window in an unsecured configuration (e.g., one or more of opened or unlocked, here opened). The fenestration assembly 500 includes a panel 504 rotatably coupled to a frame 502, by a hinge assembly. Accordingly, the panel 504 is rotatable between the open position (as shown in the example of FIG. 5A) and the closed position (as shown in the example of FIG. 5B).

The fenestration assembly 500 includes a locking mechanism 501 having an operating mechanism 507 and an operator 518. In one example, the operating mechanism 507 includes, but is not limited to, a bracket 506, a tie bar 528, a latch 508, and a latch fastener 520. The bracket 506 is coupled to the frame 502 and supports the tie bar 528. The tie bar 528 is movably (e.g., slidably) coupled to the bracket 506 and translatable with respect to the frame 502. The latch 508 is coupled to the tie bar 528. For instance, the latch 508 includes an engagement rail 509 (e.g., blade) coupled to the tie bar 528. The operator 518 (e.g., a handle) is operatively coupled to the tie bar 528. The tie bar 528 is translatable based on movement of the operator 518 between an actuated and an unactuated position. Accordingly, the operator 518 translates the latch 508 based on the translation of the tie bar 528 to correspondingly engage the latch fastener 520. For instance, the pin 522 of the latch fastener 520 engages with the rail 509 of the latch 508 and move along the rail 509 as the latch 508 translates (e.g., upward in the example of FIG. 5B) to couple the latch 508 to the latch fastener 520 and secure the fenestration assembly 500.

The latch fastener 520 is coupled to the panel 504. For instance, the latch fastener 520 is coupled to the side rail 511 of the panel 504. In the example of FIGS. 5A and 5B, the latch fastener 520 is a keeper. The keeper includes a pin 522 (e.g., roller) that engages with the rail 509 of the latch 508. The pin 522 secures the latch fastener 520 to the latch 508. The locking mechanism 501 includes a locked configuration and an unlocked configuration. In the locked configuration the latch 508 couples to the latch fastener 520. In the unlocked configuration, the latch 508 is decoupled from the latch fastener 520.

A status monitoring assembly 503 includes a sensor 530 and a sensor operator 532. The sensor 530 and the sensor operator 532 include, but are not limited to, the sensors and sensor operators as described herein. For instance, the sensor includes, but is not limited to a reed switch, magnetic sphere switch, or the like. In the example of a reed switch or magnetic sphere switch, the sensor operator includes, but is not limited to, a magnet. In other examples the sensor 524 and sensor operator 527 is one or more of the types previously described herein. In one example, the sensor 530 is attached to the rail 509 of the latch 508. In the example of FIGS. 5A and 5B, the rail 509 (e.g., latch blade) includes a tapered portion 523 and a locking portion 525. The tapered portion 523 biases the pin 522 toward the locking portion 525. In this example, the sensor operator 532 is coupled to the keeper of the latch fastener 520. The sensor 530 detects the sensor operator 532 (e.g., a magnet) when the latch 508 is coupled with the latch fastener 520. Accordingly, the status monitoring assembly 503 detects (e.g., reports) the secure and unsecure configurations.

FIG. 5A depicts one example of the fenestration assembly 500 in the unsecure configuration having the panel 504 in the open position and the locking mechanism 501 in the uncoupled configuration. For instance, in the example with the sensor 524 including a reed switch, the sensor operator 532 is spaced from the sensor 524 (reed switch) and thus the sensor 524 causes an open circuit and thereby the status monitoring assembly 503 fails to transmit a signal indicating a secure configuration, and accordingly the status monitoring assembly 503 shows an unsecure configuration FIG. 5B is a perspective view of one example of the fenestration assembly 500 (e.g., casement window) of FIG. 5A in the secure configuration with the panel 504 closed and locked. The panel 504 is rotated from the open position to the closed position. In the secure configuration, the sensor 530 is positioned adjacent to the sensor operator 532 and the sensor 530 detects the operator 532. Because the latch fastener 520 including the operator 532 is detected with both closing and locking of the fenestration assembly 500, the status monitoring assembly 503 reliably detects the secure configuration with a unitary sensor 524. The status monitoring assembly 503 reports the secure configuration with the panel 504 in the closed position and the latch 508 coupled to the latch fastener 520. For instance, the sensor 530 is communicatively coupled to the status monitoring 503 assembly. For example, the sensor 530 is communicatively coupled to a module 514 (similar to the modules 114, 414 as previously described herein) of the status monitoring assembly 503 by a wire. Accordingly, the sensor 530 is communicatively coupled to the module 514.

Figure 6:
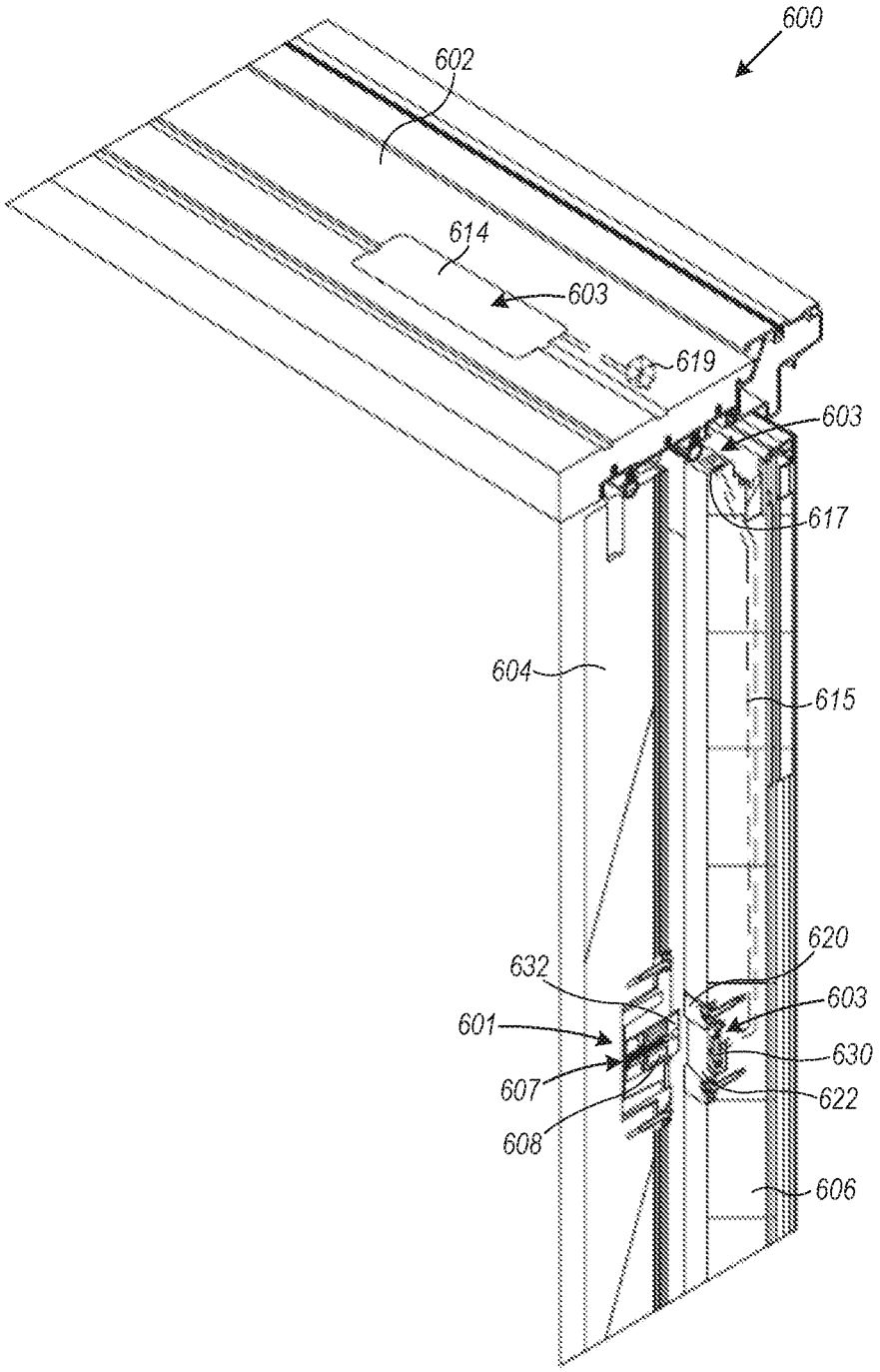
FIG. 6 is a section view of one example of a fenestration assembly including a slider window having a further example of a locking mechanism and a further example of panel interface.

FIG. 6 is a section view of one example of a fenestration assembly 600 including slider window (i.e., a glider window) having a further example of a locking mechanism 601 and a further example of a panel interface 617. For instance, the fenestration assembly 600 includes a first panel 604, a second panel 606, or both slidably coupled within a frame 602 between an open position and a closed position. The fenestration assembly 600 includes a locking mechanism 601 coupled between the first panel 604 and the second panel 606. In the closed position, the locking mechanism 601 couples the first panel 604 to the second panel 606. For instance, the locking mechanism 601 includes an operating mechanism 607 and a latch fastener 620. The operating mechanism 607 includes a latch 608 coupled with a latch recess 622 of the latch fastener 620 when the operating mechanism 607 is locked as previously described herein. The operating mechanism 607 includes an operator that moves the latch 608 between a coupled configuration and a decoupled configuration. In one example, the operator includes, but is not limited to, a handle, slider, button or other actuator.

In the example of FIG. 6, the fenestration assembly 600 includes a status monitoring assembly 603. The status monitoring assembly 603 includes a sensor 630 and a sensor operator 632. The sensor 630 detects the sensor operator 632 when the locking mechanism 601 is locked (e.g., the latch 608 is coupled with the latch fastener 620) as previously described. As shown in FIG. 6, the sensor 630 is located within the latch recess 622, for instance, attached to the latch fastener 620. The sensor operator 632 is located on the latch 608 and is detected by the sensor 630 when the latch 608 is coupled with the latch fastener 620. In one example, the latch 608 is only coupled to the latch fastener 620 when the first panel 604 and the second panel 606 are closed. In other words, the latch 608 and the latch fastener 620 are only aligned for locking when the first panel 604 and the second panel 606 are closed. Accordingly, the status monitoring assembly 603 reports the secure configuration when the latch 608 is coupled with the latch fastener 620. Because the latch 520 including the operator 632 is detected when the fenestration assembly 600 is both closed and locked, the status monitoring assembly 603 reliably detects the secure configuration with a unitary sensor 630.

The sensor 630 is communicatively coupled to the status monitoring 603 assembly. For example, the sensor 630 is communicatively coupled to a module 614 (similar to the module 114, 414, or 514 previously described herein) of the status monitoring assembly 603 by a wire 615. In one example, where at least one of the first panel 604 or the second panel 606 are non-operative (e.g., fixed in the frame 602), the wire is routed through the frame 602 into the respective panel and to the status monitoring assembly 603. For example, the sensor 630 is communicatively coupled to the module 614.

In a further example, the fenestration assembly 600 includes the panel interface 617 and a frame interface 619. The panel interface 617 is coupled to at least one of the first panel 604, the second panel 606, or both. In the example of FIG. 6, the panel interface 617 is coupled to the second panel 606. The frame interface 619 is coupled to the frame 602. The sensor 630 is communicatively coupled to the module 614 through the panel interface 617 and the frame interface 619. For instance, the sensor 630 is electrically coupled to the panel interface 617 with a wire 615. The panel interface 617 is engageable with the frame interface 619 to provide electrical communication between the sensor 630 (located on the panel) and the status monitoring assembly 603 (located in the frame 602 or other structure in which the fenestration assembly 600 is installed). The panel interface 617 engages with the frame interface 619 when the panel (e.g., the second panel 606) is in the closed configuration. Accordingly, for example, the secure configuration is communicated to the status monitoring assembly 603 when the panel is in the closed configuration and the sensor 630 detects the sensor operator 632. Optionally, the secure configuration is only communicated to the module 614 (or other component of the status monitoring assembly 603 as described herein) when the panel (e.g., the first panel 604 or second panel 606) is in the closed configuration and the sensor 630 detects the sensor operator 632. In various examples, the panel interface 617, the frame interface 619, or both include, but are not limited to, spring probes, electrical spring contacts, flat electrical contacts or the like. For instance, in the example of a spring probe, a rounded tip of the spring probe translates along the sash of the panel or the frame 602 and is electrically coupled with the respective panel interface 617 or frame interface 619 when the panel is in the closed configuration.

Figure 7:
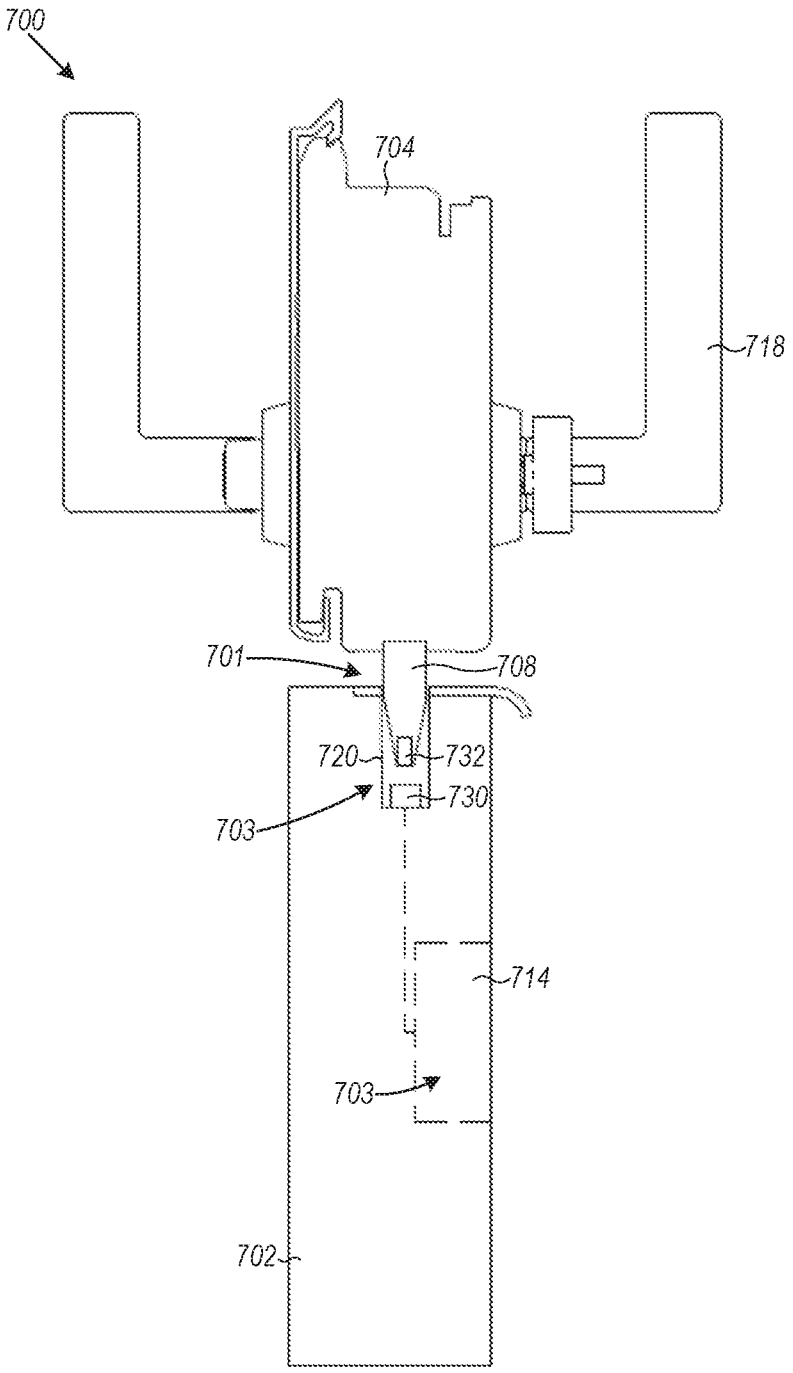
FIG. 7 depicts a cross section view of one example of fenestration assembly including a door assembly with a door in a closed position.

FIG. 7 depicts a cross section of one example of fenestration assembly 700 including a door assembly with a panel 704 (e.g., door panel) in a closed position. The panel 704 is hingedly coupled to a frame 702. The panel 704 is rotatable between an open position and a closed position. As shown in FIG. 7, the panel 704 is shown in the closed position. In one example, a locking mechanism 701 is coupled with the panel 704. In the example of FIG. 7, the locking mechanism 701 includes a latch 708, and an operator 718. The latch 708 is moveably coupled with the panel 704 and is movable between a locked position and an unlocked position by the operator 718. As shown, the operator 718 includes, for example, a handle. In the example of FIG. 7, the latch 708 includes a latch bolt that is translatable between an extended (locked) and a retracted (unlocked) position with respect to the panel 704. In the locked position, the latch 708 couples with a latch fastener 720 located on the frame 704 if the panel 704 is closed. The panel 704 is in the secure configuration when the panel 704 is in the closed position and the latch 708 is coupled with the latch fastener 720.

As described in other examples herein, the fenestration assembly 700 includes a status monitoring assembly 703. The status monitoring assembly 703 includes a sensor 730 and sensor operator 732. In the example shown in FIG. 7, the sensor 730 is located with the recess of the latch fastener 720 and the sensor operator 732 is coupled to the latch 708. The sensor 730 detects when the latch 708 is coupled with the latch fastener 720 by detecting the proximity of the sensor operator 732 to the sensor 730. Accordingly, the status monitoring assembly 703, including the module 714, detects when the fenestration assembly 700 is in the secure configuration, for instance, the sensor 730 detects the sensor operator 732 when the panel 704 is closed and the latch 708 (including the sensor operator 732 located on the tip portion) is in the locked position (received within the recess of the latch fastener 720). Accordingly, the status monitoring assembly 703 reliably detects the secure configuration with a unitary sensor 730.

In one example, a module 714 (e.g., similar to the module 114, 414, 514, and 614 as previously described herein) is located within the frame 702 as shown in the example of FIG. 7. In further examples, a battery or other component of the status monitoring assembly 703 is optionally located within the frame 702 independently or in addition to the module 714. Accordingly, one or more components of the module 714 are concealed within the frame 702.

Figure 8A:
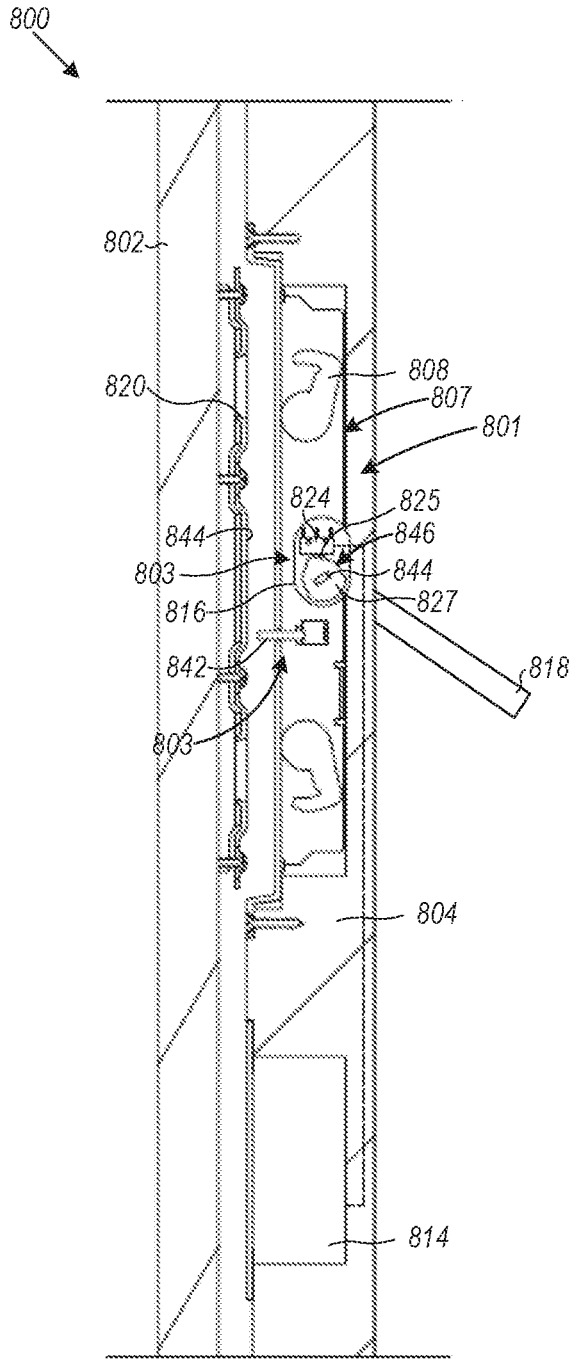
FIG. 8A is an illustration of a front cross section of a fenestration assembly in an unsecure configuration, the fenestration assembly including one example of a status monitoring assembly.
Figure 8B:
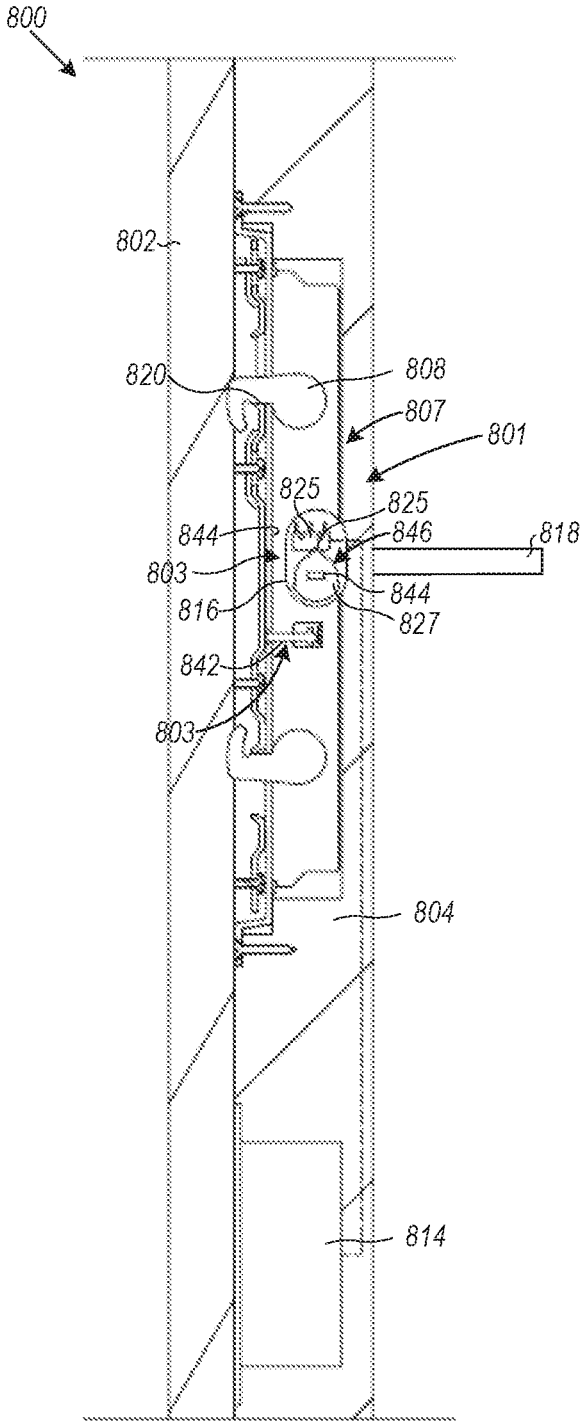
FIG. 8B illustrates of a front cross section of the fenestration assembly of FIG. 8A in a secure configuration.

FIGS. 8A and 8B illustrate a cross section of one example of a fenestration assembly 800 including a further example of a status monitoring assembly 803. The fenestration assembly 800 includes a panel 804. As shown in the example of FIGS. 8A and 8B, the panel 804 includes a sliding door. The status monitoring assembly 803 includes a sensor 824 and a sensor operator 827. In the example of FIGS. 8A and 8B, the sensor operator 827 includes a cam face 846. In FIG. 8A the fenestration assembly 800 is shown in one example of the unsecure configuration. The fenestration assembly 800 includes a locking mechanism 801. The locking mechanism 801 includes an operating mechanism 807 coupled with the panel 804. The operating mechanism 807 includes a cam spindle 844 having the cam face 846. The operating mechanism 807 includes an operator 818 (e.g., a handle). The cam spindle 844 rotates between a locked configuration and an unlocked configuration corresponding to the rotation of the operator 818. The locking mechanism 801 further includes a latch 808 (or a plurality of latches as shown). In the example of FIGS. 8A and 8B, the latch 808 is a sliding door latch (e.g., hook or claw) coupled with the cam face 846 by the cam spindle 844. The latch 808 is movable between a locked position (e.g., coupled) and an unlocked position e.g., decoupled) based on the rotation of the operator 818, and correspondingly, the cam spindle 844. FIG. 8A shows an example of the latch 808 in the unlocked configuration (e.g., retracted or partially retracted into the panel 804).

The sensor 824 is coupled with the panel 804. For instance, the cam spindle 844, cam face 846, and the sensor 824 are optionally supported by an operator housing 816 attached to the panel 804. In various examples, the sensor 824 includes, but is not limited to, a switch (e.g., detect switch 124 as shown, for instance, in FIGS. 3A and 3B end described further herein), optical sensor or other electrical or mechanical sensor for detecting a sensor operator 827 as described herein. In the example of FIGS. 8A and 8B, the sensor operator 827 is the cam face 846. The sensor 824 is a detect switch including an actuator 825. The actuator 825 is aligned along the cam face 846. For instance, the actuator 825 follows the cam surface 846 and moves between an actuated and an actuated position depending upon the position of the cam face 846. In other words, the sensor 824 is aligned with the cam face 846 and detects the movement (e.g., rotation) of the cam spindle 844 and corresponding movement of the cam surface 846. In the example of FIG. 8A, the cam spindle 844 is positioned in the unlocked configuration where the sensor 824 detects the unlocked position of the cam surface 846.

Optionally, the locking mechanism 801 includes a release 842. The release 842 prohibits the latch 808 from moving from the decoupled configuration (e.g., retracted position) to the coupled configuration (e.g., extended and latched position unless the release 842 is engaged with a strike plate 844 on the frame 802. For instance, when the panel 804 is in the open position, the release 842 is extended from the panel 804. The release 842 frees the operating mechanism (e.g., including the operator 818) to move the latch 808 when the panel 804 is in the closed position. In one example, the release 842 includes a mechanical linkage operatively coupled with the spindle 844 and the operator 818. Accordingly, in the example of FIGS. 8A and 8B, the locking mechanism 801 cannot be moved to the locked configuration unless the panel 804 is closed. When the release is engaged with the strike plate 844 and the sensor 824 detects the sensor operator 827, the status monitoring assembly 803 detects the secure configuration as the panel 804 is correspondingly closed and the locking mechanism 801 is correspondingly locked. Accordingly, the status monitoring assembly 803 detects the secure configuration with the unitary sensor 824.

In a further example, the fenestration assembly 800 includes a panel interface and a frame interface (e.g., the panel interface 617 and frame interface 619 as previously described herein). The panel interface is communicatively coupled with the frame interface when the panel 804 is closed. Accordingly, the sensor 824 reports the secure configuration only when the panel 804 is closed and the cam spindle 844 is in the locked configuration.

As shown in the example, of FIG. 8B, the cam spindle 844 is rotated with respect to the sensor 824. The cam surface 846 is rotated corresponding to the cam spindle 844 and the profile of the cam surface 846 engages the sensor 824 (e.g., the actuator 825 of the sensor 824) to actuate the sensor 824. Accordingly, where the latch 808 is in the locked position, the sensor 824 detects the locked position of the cam surface 846. If the panel 804 is in the closed position and the cam surface 846 is in the locked position the secure configuration is reported by the status monitoring assembly 803. For instance the sensor 824 is communicatively coupled to a module 814 (similar to the modules 114, 414 as previously described herein) of the status monitoring assembly 803 by a wire. Accordingly, the sensor 824 is communicatively coupled to the module 814.

Figure 9A:
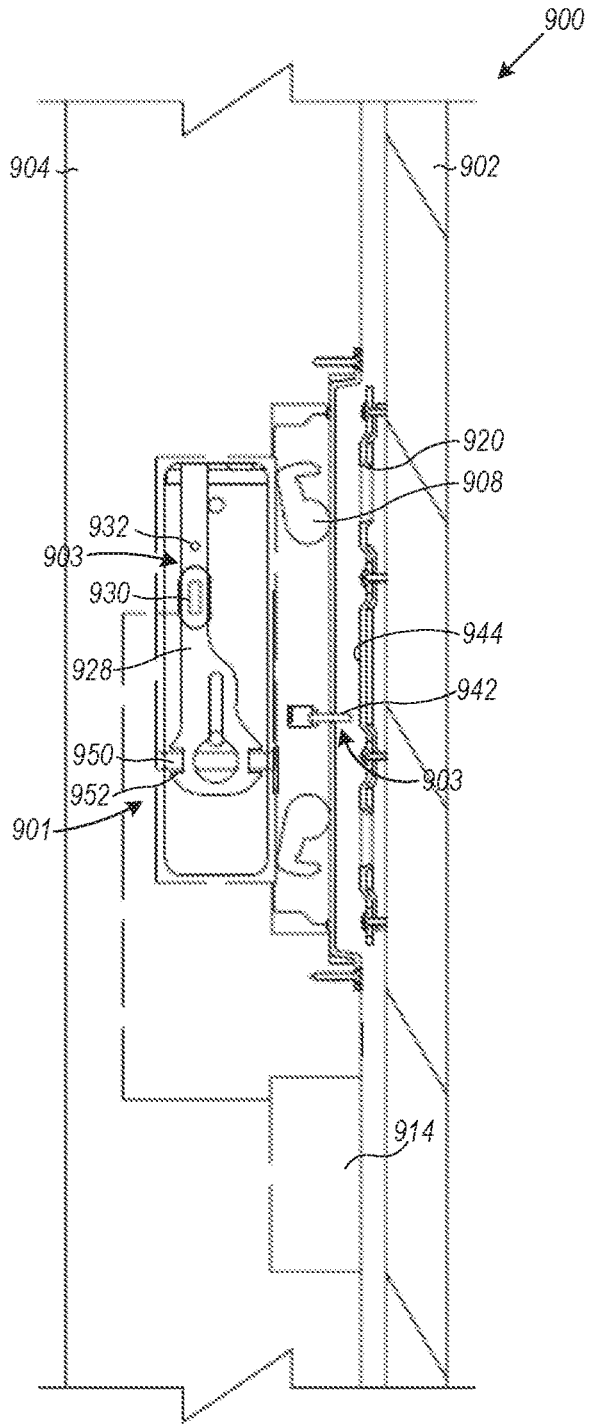
FIG. 9A depicts a front view of one example of a fenestration assembly having a locking mechanism including a tie bar and a sensor in the unsecure configuration.
Figure 9B:
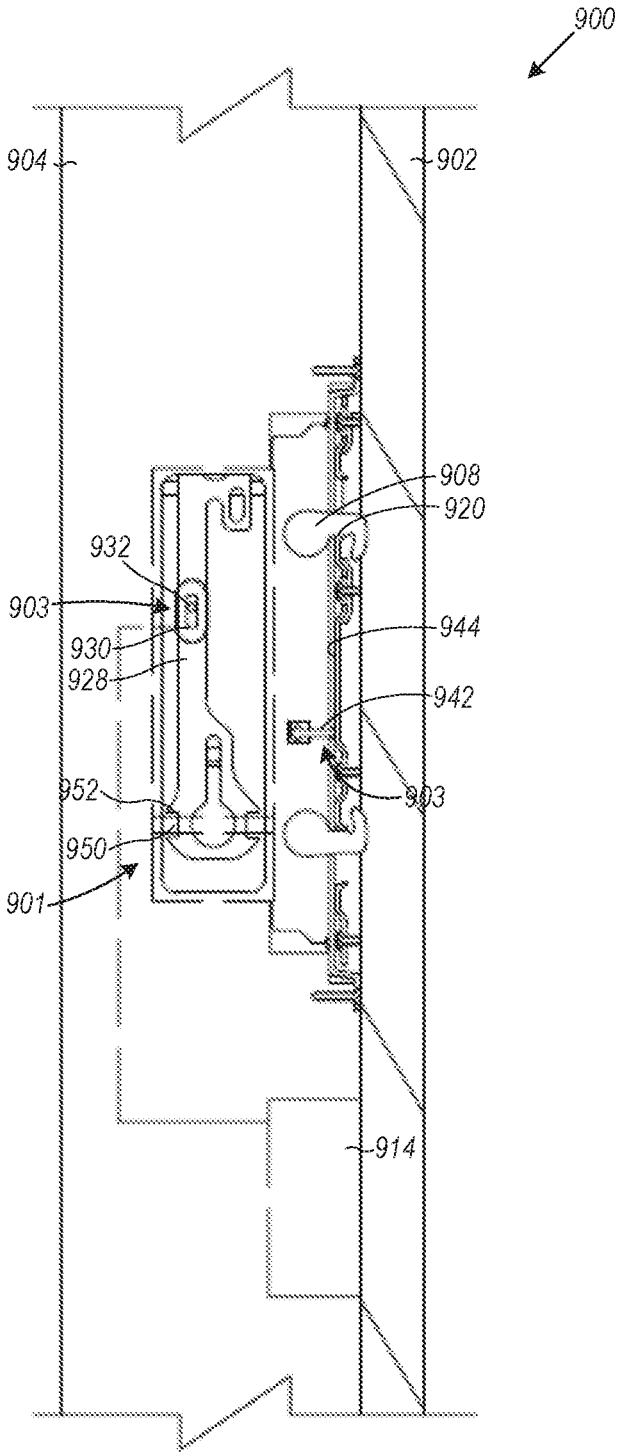
FIG. 9B depicts a front view of the example of FIG. 10A including a locking mechanism in the secure configuration.

FIGS. 9A and 9B depict a front view of one example of a fenestration assembly 900 having a locking mechanism 901 including a tie bar 928. In the example of FIGS. 9A and 9B, the fenestration assembly 900 is a sliding door. The locking mechanism 901 includes an operating mechanism 907 coupled with a panel 904 (e.g., a sliding door panel). The operating mechanism 907 includes the tie bar 928, an operator, and an engagement member 950. The tie bar 928 is moveably coupled within the panel 904. For instance, the tie bar 928 translates (e.g., vertically) within the panel 904 to move one or more latches 908 between the coupled and decoupled positions. In one example, an operator is operatively coupled to the tie bar 928 with the engagement member 950 to move the tie bar 928 between locked and unlocked configurations. The operator includes, but is not limited to, a handle, slider, button, lever or the like. In the example, of FIG. 9A, the engagement member 950 includes a lug engaged with a holder 952 of the tie bar 928. Accordingly, movement of the operator translates the lug and correspondingly the tie bar 928 to move the latch 908 between the locked position and the unlocked position. As shown in the example of FIG. 9A, the locking mechanism 901 is unlocked. Accordingly, the panel 904 is free to move between the open position and the closed position.

In a further example, the fenestration assembly 900 includes a status monitoring assembly 903 including a sensor 930 and a sensor operator 932 as previously described. The sensor 930 is coupled to the panel 904. In the example of FIGS. 9A and 9B, the sensor operator 932 is located on the tie bar 928, in a further example, the engagement member 950 is the sensor operator 932. In the unsecure configuration as shown in FIG. 9A, the sensor operator 932 is located at a distance from the sensor 930. Accordingly, the sensor operator 932 is undetectable by the sensor 930. In the example of FIG. 9B, the sensor operator 932 (e.g., the engagement member 950) is moved with respect to the panel 904 (e.g., moved upward). The tie bar 928 is moved corresponding to the movement of the engagement member 950 and the operator. Movement of the tie bar 928 causes the latch 908 to extend and couple with a latch fastener 920 located in the frame 902. Accordingly, the sensor operator 932 is positioned adjacent to the sensor 930 and the sensor 930 detects the locking mechanism 901 is in the locked configuration. Examples of the latch 908, latch fastener 920, and frame 902 include examples as previously described herein.

Optionally, the locking mechanism 901 includes a release 942. The release 942 prohibits the latch 908 from moving from the decoupled configuration (e.g., retracted position) to the coupled configuration (e.g., extended and latched position) unless the release 942 is engaged with a strike plate 944 on the frame 902. For instance, when the panel 904 is in the open position, the release 942 is extended from the panel 904. The release 942 frees the operating mechanism (e.g., including the operator) to move the latch 908 when the panel 904 is in the closed position. In one example, the release 942 includes a mechanical linkage operatively coupled with the engagement member 950 and latch 908. Accordingly, in the example of FIGS. 9A and 9B, the locking mechanism 901 cannot be moved to the locked configuration unless the panel 904 is closed. When the release is engaged with the strike plate 944 or the frame 902 and the sensor 924 detects the sensor operator 927, the status monitoring assembly 903 detects the secure configuration as the panel 904 is correspondingly closed and the locking mechanism 901 is correspondingly locked. Accordingly, the status monitoring assembly 903 detects the secure configuration with the unitary sensor 924.

In one example, the fenestration assembly 900 includes a panel interface and a frame interface (similar to the panel interface 617 and frame interface 619 as previously described herein). The panel interface is communicatively coupled with the frame interface when the panel 904 is closed. Accordingly, the sensor 930 reports the secure configuration only when the panel 904 is closed and the sensor 930 detects the sensor operator 932 (e.g., the locking mechanism 901 is locked). For instance the sensor 930 is communicatively coupled to a module 914 (similar to the modules 114, 414 as previously described herein) of the status monitoring assembly 903 by a wire. Accordingly, the sensor 930 is communicatively coupled to the module 914.

Figure 10:
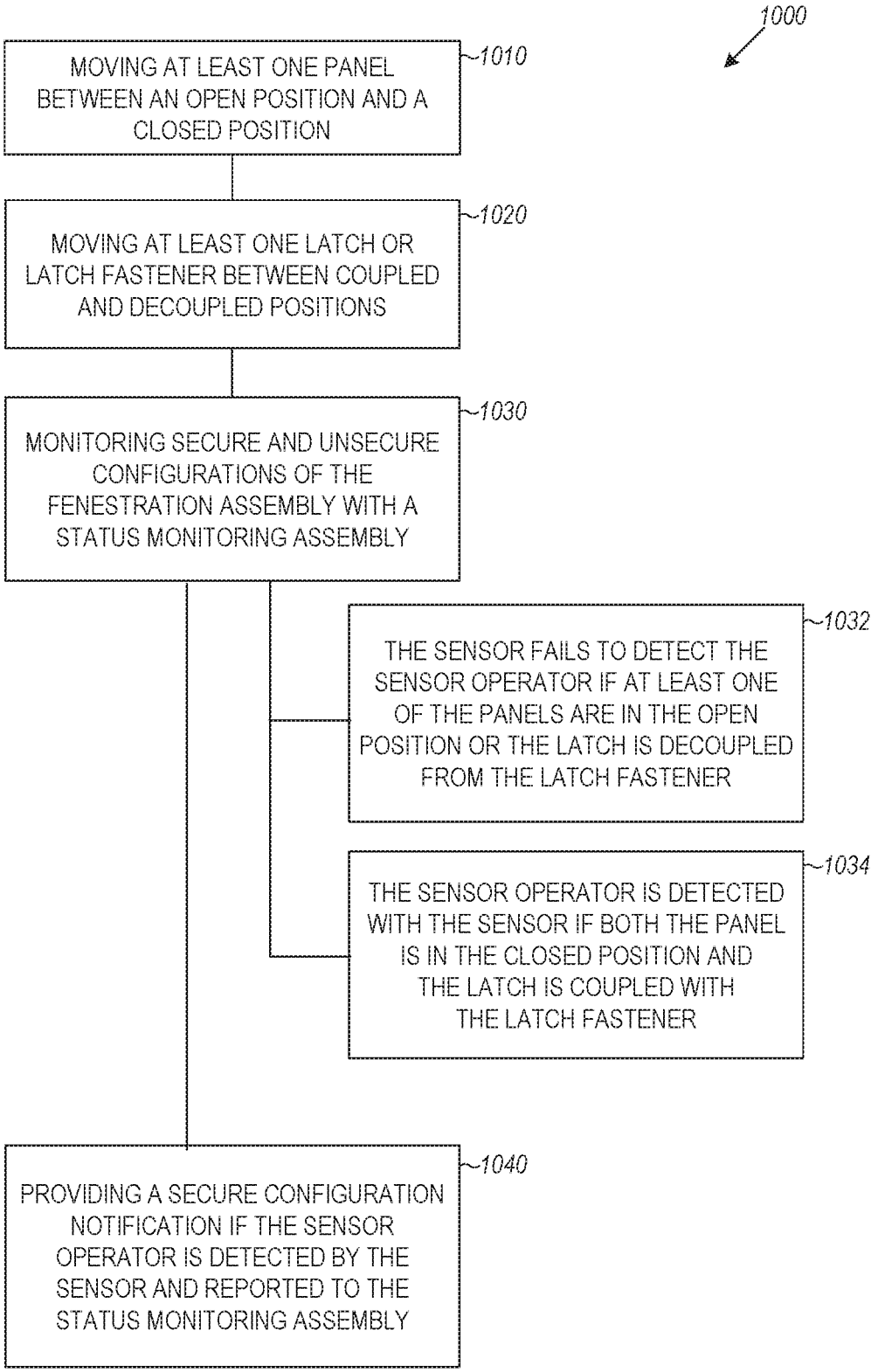
FIG. 10 is a block diagram of one example of a method of monitoring a status of a fenestration assembly.

FIG. 10 is a block diagram of one example of a method 1000 of monitoring a status of a fenestration assembly, for instance, the examples of fenestration assemblies shown in FIGS. 1-9B and described herein. In describing the method 1000, reference is made to one or more components, features, functions, and steps previously described herein. Where convenient, reference is made to the components, features, steps and the like with reference numerals. Reference numerals provided are exemplary and are nonexclusive. For instance, features, components, functions, steps, and the like described in the method 1000 include, but are not limited to, the corresponding numbered elements provided herein. Other corresponding features described herein (both numbered and unnumbered) as well as their equivalents are also considered.

At 1010, at least one panel is moved between an open position and a closed position relative to a fenestration frame. Moving the at least one panel includes, but is not limited to, one or more of moving a first sash between respective open and closed positions or moving a second sash between respective open and closed positions. For instance, the first sash or the second sash is a first panel or a second panel of a double hung window assembly, a sliding window assembly, a glider window assembly, a sliding door assembly, a casement window assembly, a hinged door panel assembly or the like.

At 1020, at least one latch or latch fastener is moved between coupled and decoupled positions relative to the other of the latch fastener or the latch. In various examples, the latch is coupled with the first sash and the latch fastener is coupled with the second sash. Moving the latch or latch fastener relative to the other of the latch fastener or the latch optionally includes receiving a latch bolt within a latch recess. In one example, a first latch is moved relative to a first latch fastener between a coupled and a decoupled configuration, where the first sash (e.g., first panel) is fixed (e.g., held static) with respect to a frame. In a further example, the first latch fastener is moved relative to the first latch between the coupled and the decoupled configuration, where the first sash is fixed with respect to the frame. In another example, a second latch is moved relative to a second latch fastener between the coupled and decoupled position, where the second sash (e.g., second panel) is fixed with respect to the frame (e.g., held static). In yet a further example, the second latch fastener is moved relative to the second latch between the coupled position and the decoupled position where the second sash is held static.

At 1030, a secure and an unsecure configuration of the fenestration assembly are monitored with a status monitoring assembly. The status monitoring assembly includes a sensor and a sensor operator. In one example, the sensor operator and the sensor include a first sensor operator and a first sensor. Monitoring the secure and unsecure configurations of the fenestration assembly optionally includes monitoring secure and unsecure configurations of the first sash. In a further example, the sensor operator and the sensor include a second sensor operator and a second sensor. Monitoring the secure and unsecure configurations of the fenestration assembly includes monitoring at least one of the secure and unsecure configurations of the second sash, the secure and unsecure configurations of the first sash, or both. Monitoring for the secure and the unsecure configurations optionally includes at least the steps of 1032 and 1034 below.

At 1032, the sensor fails to detect the sensor operator if at least one of the panels are in the open position or the latch is decoupled from the latch fastener. In one example, an unsecure configuration notification is provided (e.g., by the status monitoring assembly) if the sensor operator is not detected by the sensor. In various examples, the first sensor fails to detect the first sensor operator if the first sash is in the open position, or the first latch is decoupled from the first latch fastener. The second sensor fails to detect the second sensor operator if the second sash is in the open position or the second latch is decoupled from the second latch fastener, or any combination thereof.

At 1034, the sensor communicates the detection of the sensor operator if both the panel is in the closed position and the latch is coupled with the latch fastener. Optionally, detecting the sensor operator with the sensor includes detecting a magnet with a magnetic sensor (e.g., a reed switch or magnetic sphere switch, such as those manufactured by the Magnasphere Corporation of Waukesha, Wis.). In some examples, detecting the sensor operator with the sensor includes detecting the sensor operator if the latch bolt is received within the latch recess. In one example, the sensor detects the sensor operator only if the panel is in the closed position and the latch is coupled with the latch fastener. Where the fenestration assembly includes more than one sash (e.g., panel), for instance, a first sash and a second sash, the first sensor detects the first sensor operator if both the first sash is in the closed position and the first latch is coupled with the first latch fastener. In a further example, the second sensor detects the second sensor operator if both the second sash is in the closed position and the second latch is coupled with the second latch fastener. In another example, the sensor detects the sensor operator if each of the first and second sashes are in the closed position and the latch is coupled with the latch fastener.

Optionally, the sensor is electrically coupled with a sash interface (e.g., panel interface). A frame interface is coupled with the fenestration frame. Detecting the sensor operator with the sensor includes engaging the sash interface with the frame interface to complete a circuit. In various examples, the respective sash interface is engaged with a respective frame interface when the sash is in the closed position. Accordingly, the sensor is communicatively coupled with the status monitoring assembly when the sash (e.g., a first panel, second panel, or both) are in the closed configuration.

At 1040, a secure configuration notification is provided if the sensor operator is detected by the sensor. For instance, providing the secure configuration notification includes, but is not limited to, providing a signal from the sensor, transmitting a notification from a wireless transceiver communicatively coupled to the sensor or the like. In one example, providing the secure configuration notification includes providing the secure configuration notification only if the sensor operator is detected by the sensor.

VARIOUS NOTES & EXAMPLES

Example 1 includes subject matter such as a fenestration assembly configured for status monitoring, the fenestration assembly comprising: a fenestration frame; at least one panel movably coupled with the fenestration frame between open and closed positions; a locking mechanism coupled with the at least one panel, the locking mechanism includes at least one latch and at least one latch fastener; wherein the at least one panel includes secure and unsecure configurations, in the secure configuration the at least one panel is in the closed position and the latch is coupled with the latch fastener, and in the unsecure configuration one or more of the at least one panel is in the open position or the latch is decoupled from the latch fastener; and a status monitoring assembly configured to monitor the secure and unsecure configurations of the fenestration assembly, the status monitoring assembly includes: a sensor operator coupled with at least one of the latch or the latch fastener, and a sensor coupled with one of the fenestration frame or the at least one panel, and the sensor is configured to communicate a detection of the sensor operator if the at least one panel is in the secure configuration with the at least one panel in the closed position and the latch is coupled with the latch fastener.

Example 2 includes, or is optionally combined with the subject matter of Example 1, to optionally include wherein the status monitoring assembly is configured to report the secure configuration with the sensor operator detected by the sensor, and the status monitoring assembly is configured to report the unsecure configuration with the sensor operator undetected by the sensor.

Example 3 includes, or is optionally combined with the subject matter of one or any combination of Examples 1 or 2 to optionally include wherein the latch includes a latch bolt movably coupled with the panel, the latch fastener includes a latch recess within the fenestration frame, and the latch recess is configured to receive the latch bolt in the secure configuration.

Example 4 includes, or is optionally combined with the subject matter of one or any combination of Examples 1-3 to optionally include wherein the sensor is immediately adjacent to the latch recess, and the sensor operator is coupled with a latch bolt tip portion.

Example 5 includes, or is optionally combined with the subject matter of one or any combination of Examples 1-4 to optionally include wherein the at least one panel includes a first panel and a second panel, and the first and second panels are movable relative to each other and the fenestration frame.

Example 6 includes, or is optionally combined with the subject matter of Examples 1-5 to optionally include wherein the latch is coupled with the first panel and the latch fastener is coupled with the second panel.

Example 7 includes, or is optionally combined with the subject matter of Examples 1-6 to optionally include wherein the second panel includes a panel interface in electrical communication with the sensor, the fenestration frame includes a frame interface configured for engagement with the panel interface with the second panel in the closed position.

Example 8 includes, or is optionally combined with the subject matter of Examples 1-7 to optionally include wherein the secure configuration includes the first and second panel in respective closed positions, the latch is coupled with the latch fastener and the panel interface is coupled with the frame interface.

Example 9 includes, or is optionally combined with the subject matter of Examples 1-8 to optionally include wherein the sensor is configured to only detect the sensor operator if the panel is in the closed position, the latch is coupled with the latch fastener and the panel interface is engaged with the frame interface.

Example 10 includes, or is optionally combined with the subject matter of Examples 1-9 to optionally include wherein the at least one panel includes a door rotatable within the fenestration frame, the latch including a latch bolt movably coupled with the door and an operating mechanism configured to move the latch bolt to couple with the latch fastener.

Example 11 includes, or is optionally combined with the subject matter of Examples 1-10 to optionally include wherein the operating mechanism includes a cam spindle having a cam face, the cam spindle configured to rotate with the operating mechanism, and the sensor operator includes the cam face.

Example 12 includes, or is optionally combined with the subject matter of Examples 1-11 to optionally include wherein the sensor is coupled with the door, and the sensor includes a switch in alignment with the cam face, and the switch is configured to detect the cam face with rotation of the operating mechanism to couple the latch bolt with the latch fastener.

Example 13 includes, or is optionally combined with the subject matter of Examples 1-12 to optionally include wherein the operating mechanism includes a release extending from the door, and the release is configured to free the operating mechanism to move the latch bolt with movement of the door into the closed position.

Example 14 includes, or is optionally combined with the subject matter of Examples 1-13 to optionally include wherein the sensor is configured to detect the sensor operator only if the panel is in the closed position and the latch is coupled with the latch fastener.

Example 15 includes, or is optionally combined with the subject matter of Examples 1-14 to optionally include wherein the sensor operator is selected from the group consisting of a magnet, a mechanical contact or an electrical contact and the sensor is selected from the group consisting of a magnetic sensor, a mechanical switch or an electrical switch.

Example 16 includes, or is optionally combined with the subject matter of Examples 1-15 to optionally include wherein the sensor is concealed within one or more of the fenestration frame or the panel.

Example 17 includes, or is optionally combined with the subject matter of Examples 1-16 to optionally include wherein the sensor operator is concealed within one or more of the fenestration frame or the panel.

Example 18 includes, or is optionally combined with the subject matter of Examples 1-17 to optionally include a power source in electrical communication with the sensor, and the power source is concealed within the fenestration frame.

Example 19 includes, or is optionally combined with the subject matter of Examples 1-18 to optionally include a transceiver in electrical communication with the sensor, and the transceiver is concealed within the fenestration frame.

Example 20 includes, or is optionally combined with the subject matter of Examples 1-19 to optionally include a fenestration assembly configured for status monitoring, the fenestration assembly comprising: a fenestration frame; at least one panel movably coupled with the fenestration frame between open and closed positions; a locking mechanism coupled with the at least one panel, the locking mechanism including at least one latch and at least one latch fastener, in a locked position the at least one latch is coupled with the at least one latch fastener, and in an unlocked position the at least one latch is decoupled with the at least one latch fastener; a status monitoring assembly configured to sense secure and unsecure configurations of the fenestration assembly, the status monitoring assembly includes: a sensor operator coupled with the at least one latch, and a sensor coupled with one of the fenestration frame or the at least one panel, and the status monitoring assembly is configured to detect the sensor operator with the sensor when the at least one panel is in the closed position and the locked position; and wherein the unsecure configuration includes one or more of the at least one panel in the open position or the locking mechanism in the unlocked position and the secure configuration includes the at least one panel in the closed position and the locking mechanism in the locked position.

Example 21 includes, or is optionally combined with the subject matter of Examples 1-20 to optionally include a fenestration assembly configured for status monitoring, the fenestration assembly comprising: a fenestration frame; first and second sashes movably coupled with the fenestration frame between respective open and closed positions; a first locking mechanism coupled with the fenestration frame and the first sash, and a second locking mechanism coupled with at least one of the fenestration frame and the second sash, each of the first and second locking mechanisms respectively including at least one latch bolt and at least one latch recess; wherein the first and second sashes include respective secure and unsecure configurations, in the secure configuration the first or second sash is respectively in the closed position and the corresponding latch bolt is received within its latch recess, and in the unsecure configuration the first or second sash is respectively in one or more of the open position or the corresponding latch bolt is recessed from the respective latch recess; and a status monitoring assembly configured to monitor the secure and unsecure configurations of each of the first and second sashes, the status monitoring assembly includes: a first sensor assembly including a first sensor operator on the latch bolt for the first sash, and a first sensor configured to detect the first sensor operator if the first sash is in the respective closed position and its latch bolt is received in the respective latch recess, and a second sensor assembly including a second sensor operator on the latch bolt for the second sash, and a second sensor configured to detect the second sensor operator if the second sash is in the respective closed position and the corresponding latch bolt is received in the respective latch recess.

Example 22 includes, or is optionally combined with the subject matter of Examples 1-21 to optionally include wherein the status monitoring assembly is configured to report the secure configuration with the first and second sensor operators detected by the respective sensors, and the status monitoring assembly is configured to report the unsecure configuration with at least one of the first or second sensor operators undetected by the respective first or second sensors.

Example 23 includes, or is optionally combined with the subject matter of Examples 1-22 to optionally include wherein the first and second sensors are coupled with the fenestration frame, the first sensor is adjacent to the latch recess for the first sash, and the second sensor is adjacent to the latch recess for the second sash.

Example 24 includes, or is optionally combined with the subject matter of Examples 1-23 to optionally include wherein each of the first and second sensors is positioned within the respective latch recess for the first and second sashes.

Example 25 includes, or is optionally combined with the subject matter of Examples 1-24 to optionally include wherein the fenestration frame includes a first sash channel extending from the latch recess for the first sash, a second sash channel extending from the latch recess for the second sash, and wherein the latch recesses is recessed from the respective first and second sash channels.

Example 26 includes, or is optionally combined with the subject matter of Examples 1-25 to optionally include wherein one or more of the first or second sensor operators is selected from the group consisting of a magnet, a mechanical contact or an electrical contact and one or more of the first or second sensors is selected from the group consisting of a magnetic sensor, a mechanical switch or an electrical switch.

Example 27 includes, or is optionally combined with the subject matter of Examples 1-26 to optionally include a power source in electrical communication with the first and second sensors, and the power source is concealed within the fenestration frame.

Example 28 includes, or is optionally combined with the subject matter of Examples 1-27 to optionally include a transceiver in electrical communication with the first and second sensors, and the transceiver is concealed within the fenestration frame.

Example 29 includes, or is optionally combined with the subject matter of Examples 1-28 to optionally include a fenestration assembly configured for status monitoring, the fenestration assembly comprising: a fenestration frame; at least one sash rotatably coupled with the fenestration frame between open and closed positions; a locking mechanism coupled with the fenestration frame and the sash, the locking mechanism includes at least one latch coupled with the fenestration frame and at least one latch fastener movably coupled with the sash; wherein the sash includes secure and unsecure configurations, in the secure configuration the sash is in the closed position and the latch is coupled with the latch fastener, and in the unsecure configuration one or more of the sash is in the open position or the latch is decoupled from the latch fastener; and a status monitoring assembly configured to monitor secure and unsecure configurations of the fenestration assembly, the status monitoring assembly includes: a sensor operator coupled with the latch fastener, and a sensor coupled with the latch, and the sensor is configured to detect the sensor operator if the sash is in the closed position and the latch is coupled with the latch fastener.

Example 30 includes, or is optionally combined with the subject matter of Examples 1-29 to optionally include wherein the status monitoring assembly is configured to report the secure configuration with the sensor operator detected by the sensor, and the status monitoring assembly is configured to report the unsecure configuration with the sensor operator undetected by the sensor.

Example 31 includes, or is optionally combined with the subject matter of Examples 1-30 to optionally include wherein the locking mechanism includes a tie bar coupled with the latch fastener, and the tie bar is movably coupled with the fenestration frame and configured to couple and decouple the latch fastener with the latch.

Example 32 includes, or is optionally combined with the subject matter of Examples 1-31 to optionally include wherein the latch fastener includes a pin, and the latch includes a latch blade having a tapered portion and a locking portion, the tapered portion is configured to bias the pin toward the locking portion.

Example 33 includes, or is optionally combined with the subject matter of Examples 1-32 to optionally include wherein the tie bar is coupled with a lever arm, and the lever arm is configured to move the tie bar and the latch fastener.

Example 34 includes, or is optionally combined with the subject matter of Examples 1-33 to optionally include wherein the sensor is configured to detect the sensor operator only if the sash is in the closed position and the latch is coupled with the latch fastener.

Example 35 includes, or is optionally combined with the subject matter of Examples 1-34 to optionally include wherein the sensor operator is selected from the group consisting of a magnet, a mechanical contact or an electrical contact and the sensor is selected from the group consisting of a magnetic sensor, a mechanical switch or an electrical switch.

Example 36 includes, or is optionally combined with the subject matter of Examples 1-35 to optionally include a power source in electrical communication with the sensor, and the power source is concealed within the fenestration frame.

Example 37 includes, or is optionally combined with the subject matter of Examples 1-36 to optionally include a transceiver in electrical communication with the sensor, and the transceiver is concealed within the fenestration frame.

Example 38 includes, or is optionally combined with the subject matter of Examples 1-37 to optionally include a method for monitoring the status of a fenestration assembly comprising: moving at least one panel between an open position and a closed position relative to a fenestration frame; moving at least one latch or latch fastener between coupled and decoupled positions relative to the other of the latch fastener or the latch; monitoring secure and unsecure configurations of the fenestration assembly with a status monitoring assembly including a sensor and a sensor operator, monitoring including: failing to detect the sensor operator with the sensor at the status monitoring assembly if at least one of the panel is in the open position or the latch is decoupled from the latch fastener, and detecting the sensor operator with the sensor at the status monitoring assembly if both the at least one panel is in the closed position and the latch is coupled with the latch fastener; and providing a secure configuration notification if the sensor operator is detected by the sensor and reported to the status monitoring assembly.

Example 39 includes, or is optionally combined with the subject matter of Examples 1-38 to optionally include providing an unsecure configuration notification if the sensor operator is not detected by the sensor.

Example 40 includes, or is optionally combined with the subject matter of Examples 1-39 to optionally include wherein moving the at least one panel includes one or more of: moving a first sash between respective open and closed positions, and moving a second sash between respective open and closed positions.

Example 41 includes, or is optionally combined with the subject matter of Examples 1-40 to optionally include wherein moving the at least one latch or latch fastener includes one or more of: moving a first latch relative to a first latch fastener between coupled and decoupled positions, in the coupled position the first sash is held static, and moving a second latch relative to a second latch fastener between coupled and decoupled positions, in the coupled position the second sash is held static.

Example 42 includes, or is optionally combined with the subject matter of Examples 1-41 to optionally include wherein the sensor operator and the sensor include a first sensor operator and a first sensor, and monitoring secure and unsecure configurations of the fenestration assembly includes monitoring secure and unsecure configurations of the first sash including: failing to detect the first sensor operator with the first sensor if the first sash is in the open position or the first latch is decoupled from the first latch fastener, and detecting the first sensor operator with the first sensor if both the first sash is in the closed position and the first latch is coupled with the first latch fastener.

Example 43 includes, or is optionally combined with the subject matter of Examples 1-42 to optionally include wherein the sensor operator and the sensor include a second sensor operator and a second sensor, and monitoring secure and unsecure configurations of the fenestration assembly includes monitoring secure and unsecure configurations of the second sash including: failing to detect the second sensor operator with the second sensor if the second sash is in the open position or the second latch is decoupled from the second latch fastener, and detecting the second sensor operator with the second sensor if both the second sash is in the closed position and the second latch is coupled with the second latch fastener.

Example 44 includes, or is optionally combined with the subject matter of Examples 1-43 to optionally include wherein the latch is coupled with the first sash and the latch fastener is coupled with the second sash, and detecting the sensor operator with the sensor includes detecting the sensor operator with the sensor if each of the first and second sashes are in the closed position and the latch is coupled with the latch fastener.

Example 45 includes, or is optionally combined with the subject matter of Examples 1-44 to optionally include wherein the sensor is electrically coupled with a sash interface, and a frame interface is coupled with the fenestration frame, and detecting the sensor operator with the sensor includes engaging the sash interface with the frame interface to complete a circuit.

Example 46 includes, or is optionally combined with the subject matter of Examples 1-45 to optionally include wherein moving the at least one panel is selected from the group consisting of moving a door panel, moving a sash, moving a casement sash or moving a glider sash.

Example 47 includes, or is optionally combined with the subject matter of Examples 1-46 to optionally include wherein detecting the sensor operator with the sensor includes detecting a magnet with a magnetic sensor.

Example 48 includes, or is optionally combined with the subject matter of Examples 1-47 to optionally include wherein moving the latch or latch fastener relative to the other of the latch fastener or the latch includes receiving a latch bolt within a latch recess, and detecting the sensor operator with the sensor includes detecting the sensor operator if the latch bolt is received within the latch recess.

Example 49 includes, or is optionally combined with the subject matter of Examples 1-48 to optionally include wherein detecting the sensor operator with the sensor includes detecting the sensor operator with the sensor only if the at least one panel is in the closed position and the latch is coupled with the latch fastener.

Example 50 includes, or is optionally combined with the subject matter of Examples 1-49 to optionally include wherein providing the secure configuration notification includes providing the secure configuration notification only if the sensor operator is detected by the sensor.

Example 51 includes, or is optionally combined with the subject matter of Examples 1-50 to optionally include wherein the latch includes a locked and an unlocked position, in the locked position the latch is extended from the locking mechanism, and in the unlocked position, the latch is retracted into the locking mechanism, the sensor operator is the latch and the sensor is located adjacent to the latch and configured to detect the latch in the locked position.

Example 52 includes, or is optionally combined with the subject matter of Examples 1-51 to optionally include a release, the release includes an engaged position and a disengaged position, in the engaged position, the release frees the latch to move into the locked position.

Example 53 includes, or is optionally combined with the subject matter of Examples 1-52 to optionally include wherein the status monitoring assembly detects the secure configuration if the latch is in the locked position and the one or more panels are in the closed position.

Example 54 includes, or is optionally combined with the subject matter of Examples 1-53 to optionally include wherein the at least one panel includes a panel interface in electrical communication with the sensor, and the fenestration frame includes a frame interface configured for engagement with the panel interface with the at least one panel in the closed position, wherein the sensor is configured to communicate the detection of the sensor operator through the panel interface and the frame interface when the at least one panel is in the closed position.

Example 55 includes, or is optionally combined with the subject matter of Examples 1-54 to optionally include wherein the secure configuration includes the at least one panel in the closed position, the latch in the locked position and the panel interface is coupled with the frame interface.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples," Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more," In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein" Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A fenestration assembly configured for status monitoring, the fenestration assembly comprising:

a fenestration frame;

at least one panel movably coupled with the fenestration frame between open and closed positions, wherein the fenestration frame surrounds the at least one panel;

a locking mechanism coupled with the at least one panel, the locking mechanism includes at least one latch and at least one latch fastener;

wherein the at least one panel includes secure and unsecure configurations, in the secure configuration the at least one panel is in the closed position and the latch is coupled with the latch fastener, and in the unsecure configuration one or more of the at least one panel is in the open position or the latch is decoupled from the latch fastener; and a status monitoring assembly configured to monitor the secure and unsecure configurations of the fenestration assembly, the status monitoring assembly includes:

a sensor operator coupled with at least one of the latch or the latch fastener, wherein the sensor operator includes a detectable characteristic, the detectable characteristic including one or more of a mechanical, electrical, or magnetic characteristic; and a sensor coupled with one of the fenestration frame or the at least one panel, and the sensor is configured to communicate a detection of the detectable characteristic of the sensor -operator when the at least one panel is in the secure configuration with the at least one panel in the closed position and the latch is coupled with the latch fastener.

2. The fenestration assembly of claim 1, wherein the status monitoring assembly is configured to report the secure configuration with the sensor operator detected by the sensor, and the status monitoring assembly is configured to report the unsecure configuration with the sensor operator undetected by the sensor.

3. The fenestration assembly of claim 1, wherein the latch includes a latch bolt movably coupled with the panel, the latch fastener includes a latch recess within the fenestration frame, and the latch recess is configured to receive the latch bolt in the secure configuration.

4. The fenestration assembly of claim 3, wherein the sensor is immediately adjacent to the latch recess, and the sensor operator is coupled with a latch bolt tip portion.

5. The fenestration assembly of claim 1, wherein the at least one panel includes a first panel and a second panel, and the first and second panels are movable relative to each other and the fenestration frame.

6. The fenestration assembly of claim 5, wherein the latch is coupled with the first panel and the latch fastener is coupled with the second panel.

7. The fenestration assembly of claim 6, wherein the second panel includes a panel interface in electrical communication with the sensor, the fenestration frame includes a frame interface configured for engagement with the panel interface with the second panel in the closed position.

8. The fenestration assembly of claim 7, wherein the secure configuration includes the first and second panel in respective closed positions, the latch is coupled with the latch fastener and the panel interface is coupled with the frame interface.

9. The fenestration assembly of claim 7, wherein the sensor is configured to only detect the sensor operator when the panel is in the closed position, the latch is coupled with the latch fastener and the panel interface is engaged with the frame interface.

10. The fenestration assembly of claim 1, wherein the at least one panel includes a door rotatable within the fenestration frame, the latch including a latch bolt movably coupled with the door and an operating mechanism configured to move the latch bolt to couple with the latch fastener.

11. The fenestration assembly of claim 10, wherein the operating mechanism includes a cam spindle having a cam face, the cam spindle configured to rotate with the operating mechanism, and the sensor operator includes the cam face.

12. The fenestration assembly of claim 11, wherein the sensor is coupled with the door, and the sensor includes a switch in alignment with the cam face, and the switch is configured to detect the cam face with rotation of the operating mechanism to couple the latch bolt with the latch fastener.

13. The fenestration assembly of claim 10, wherein the operating mechanism includes a release extending from the door, and the release is configured to free the operating mechanism to move the latch bolt with movement of the door into the closed position.

14. The fenestration assembly of claim 1, wherein the sensor is configured to detect the sensor operator only when the panel is in the closed position and the latch is coupled with the latch fastener.

15. The fenestration assembly of claim 1, wherein the sensor operator is selected from the group consisting of a magnet, a mechanical contact or an electrical contact and the sensor is selected from the group consisting of a magnetic sensor, a mechanical switch or an electrical switch.

16. The fenestration assembly of claim 1, wherein the sensor is concealed within one or more of the fenestration frame or the panel.

17. The fenestration assembly of claim 16, further comprising a transceiver in electrical communication with the sensor, and the transceiver is concealed within the fenestration frame.

18. The fenestration assembly of claim 1, wherein the sensor operator is concealed within one or more of the fenestration frame or the panel.

19. The fenestration assembly of claim 1, further comprising a power source in electrical communication with the sensor, and the power source is concealed within the fenestration frame.

20. The fenestration assembly of claim 1, wherein the latch includes a locked and an unlocked position, in the locked position the latch is extended from the locking mechanism, and in the unlocked position, the latch is retracted into the locking mechanism, the sensor operator is the latch and the sensor is located adjacent to the latch and configured to detect the latch in the locked position.

21. The fenestration assembly of claim 20, further comprising a release, the release includes an engaged position and a disengaged position, in the engaged position, the release frees the latch to move into the locked position.

22. The fenestration assembly of claim 21, wherein the status monitoring assembly detects the secure configuration when the latch is in the locked position and the one or more panels are in the closed position.

23. The fenestration assembly of claim 20, wherein the at least one panel includes a panel interface in electrical communication with the sensor, and the fenestration frame includes a frame interface configured for engagement with the panel interface with the at least one panel in the closed position, wherein the sensor is configured to communicate the detection of the sensor operator through the panel interface and the frame interface when the at least one panel is in the closed position.

24. The fenestration assembly of claim 23, wherein the secure configuration includes the at least one panel in the closed position, the latch in the locked position and the panel interface is coupled with the frame interface.

25. A fenestration assembly configured for status monitoring, the fenestration assembly comprising:

a fenestration frame;

first and second sashes movably coupled with the fenestration frame between respective open and closed positions, wherein the fenestration frame surrounds the first and second sashes;

a first locking mechanism coupled with the fenestration frame and the first sash, and a second locking mechanism coupled with at least one of the fenestration frame and the second sash, each of the first and second locking mechanisms respectively including at least one latch bolt and at least one latch recess;

wherein the first and second sashes include respective secure and unsecure configurations, in the secure configuration the first or second sash is respectively in the closed position and the corresponding latch bolt is received within its latch recess, and in the unsecure configuration the first or second sash is respectively in one or more of the open position or the corresponding latch bolt is recessed from the respective latch recess; and a status monitoring assembly configured to monitor the secure and unsecure configurations of each of the first and second sashes, the status monitoring assembly includes:

a first sensor assembly including a first sensor operator having a first detectable characteristic on the latch bolt for the first sash, and a first sensor configured to detect the first detectable characteristic of the first sensor operator when the first sash is in the respective closed position and its latch bolt is received in the respective latch recess; and a second sensor assembly including a second sensor operator having a second detectable characteristic on the latch bolt for the second sash, and a second sensor configured to detect the second detectable characteristic of the second sensor operator when the second sash is in the respective closed position and the corresponding latch bolt is received in the respective latch recess, wherein the first detectable characteristic and the second detectable characteristic include one or more of a mechanical, electrical, or magnetic characteristic.

26. The fenestration assembly of claim 25, wherein the status monitoring assembly is configured to report the secure configuration with the first and second sensor operators detected by the respective sensors, and the status monitoring assembly is configured to report the unsecure configuration with at least one of the first or second sensor operators undetected by the respective first or second sensors.

27. The fenestration assembly of claim 25, wherein the first and second sensors are coupled with the fenestration frame, the first sensor is adjacent to the latch recess for the first sash, and the second sensor is adjacent to the latch recess for the second sash.

28. The fenestration assembly of claim 25, wherein each of the first and second sensors is positioned within the respective latch recess for the first and second sashes.

29. The fenestration assembly of claim 25, wherein the fenestration frame includes a first sash channel extending from the latch recess for the first sash, a second sash channel extending from the latch recess for the second sash, and wherein the latch recesses is recessed from the respective first and second sash channels.

30. The fenestration assembly of claim 25, wherein one or more of the first or second sensor operators is selected from the group consisting of a magnet, a mechanical contact or an electrical contact and one or more of the first or second sensors is selected from the group consisting of a magnetic sensor, a mechanical switch or an electrical switch.

31. The fenestration assembly of claim 25, further comprising a power source in electrical communication with the first and second sensors, and the power source is concealed within the fenestration frame.

32. The fenestration assembly of claim 25, further comprising a transceiver in electrical communication with the first and second sensors, and the transceiver is concealed within the fenestration frame.

33. A fenestration assembly configured for status monitoring, the fenestration assembly comprising:

a fenestration frame;

at least one sash rotatably coupled with the fenestration frame between open and closed positions, wherein the fenestration frame surrounds the at least one sash;

a locking mechanism coupled with the fenestration frame and the sash, the locking mechanism includes at least one latch movably coupled with the fenestration frame and at least one latch fastener coupled with the sash;

wherein the sash includes secure and unsecure configurations, in the secure configuration the sash is in the closed position and the latch is coupled with the latch fastener, and in the unsecure configuration one or more of the sash is in the open position or the latch is decoupled from the latch fastener; and a status monitoring assembly configured to monitor secure and unsecure configurations of the fenestration assembly, the status monitoring assembly includes:

a sensor operator coupled with the latch fastener, wherein the sensor operator includes a detectable characteristic, the detectable characteristic including one or more of a mechanical, electrical, or magnetic characteristic; and a sensor coupled with the latch, and the sensor is configured to detect the detectable characteristic the sensor operator when the sash is in the closed position and the latch is coupled with the latch fastener.

34. The fenestration assembly of claim 33, wherein the status monitoring assembly is configured to report the secure configuration with the sensor operator detected by the sensor, and the status monitoring assembly is configured to report the unsecure configuration with the sensor operator undetected by the sensor.

35. The fenestration assembly of claim 33, wherein the locking mechanism includes a tie bar coupled with the latch, and the tie bar is movably coupled with the fenestration frame and configured to couple and decouple the latch with the latch fastener.

36. The fenestration assembly of claim 35, wherein the latch fastener includes a pin, and the latch includes a latch blade having a tapered portion and a locking portion, the tapered portion is configured to bias the pin toward the locking portion.

37. The fenestration assembly of claim 35, wherein the tie bar is coupled with a lever arm, and the lever arm is configured to move the tie bar and the latch.

38. The fenestration assembly of claim 33, wherein the sensor is configured to detect the sensor operator only when the sash is in the closed position and the latch is coupled with the latch fastener.

39. The fenestration assembly of claim 33, wherein the sensor operator is selected from the group consisting of a magnet, a mechanical contact or an electrical contact and the sensor is selected from the group consisting of a magnetic sensor, a mechanical switch or an electrical switch.

40. The fenestration assembly of claim 33 comprising a power source in electrical communication with the sensor, and the power source is concealed within the fenestration frame.

41. The fenestration assembly of claim 33 comprising a transceiver in electrical communication with the sensor, and the transceiver is concealed within the fenestration frame.

* * * * *